US010164367B2

(12) United States Patent
Motohashi

(10) Patent No.: US 10,164,367 B2
(45) Date of Patent: Dec. 25, 2018

(54) CONNECTOR

(71) Applicant: Molex, LLC, Lisle, IL (US)

(72) Inventor: Nobumasa Motohashi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/935,522

(22) Filed: Mar. 26, 2018

(65) Prior Publication Data

US 2018/0287285 A1 Oct. 4, 2018

(30) Foreign Application Priority Data

Mar. 31, 2017 (JP) ..... 2017-069523

(51) Int. Cl.

| | |
|---|---|
| ***H01R 24/00*** | (2011.01) |
| ***H01R 13/26*** | (2006.01) |
| ***H01R 12/71*** | (2011.01) |
| ***H01R 13/41*** | (2006.01) |

(52) U.S. Cl.

CPC ..... *H01R 13/26* (2013.01); *H01R 12/716* (2013.01); *H01R 13/41* (2013.01)

(58) Field of Classification Search

CPC ..... H01R 23/025; H01R 24/40; H01R 43/205
USPC ..... 439/676, 941, 344
See application file for complete search history.

(56) References Cited

U.S. PATENT DOCUMENTS 5,316,489 A * 5/1994 Kachlic ..... H01R 12/721 439/569
6,045,391 A * 4/2000 Jaag ..... H01R 4/2433 439/405
6,083,051 A * 7/2000 Chang ..... H01R 12/716 439/660
6,196,880 B1 3/2001 Goodrich et al.
6,505,402 B2 * 1/2003 Moriwake ..... H01R 43/16 264/272.11
7,008,250 B2 * 3/2006 Shuey ..... H01R 13/112 439/265

(Continued)

FOREIGN PATENT DOCUMENTS

JP 2001-118642 A 4/2001

*Primary Examiner* — Phuong Chi T Nguyen
(74) *Attorney, Agent, or Firm* — James A. O'Malley

(57) ABSTRACT

Coupling between terminals can be properly arranged and the effect of crosstalk and noise can be surely and significantly reduced. Including a pair consisting of a first terminal and a second terminal, each of the first terminal and the second terminal includes a contact part extending in the anteroposterior direction, an upper plate and a lower plate extending in the vertical direction, a link section extending in the lateral direction and linking up with the upper plate and the lower plate, the contact part of the first terminal is opposite the contact part of the second terminal in the vertical direction, the upper plate of the first terminal is opposite the upper plate of the second terminal in the lateral direction, the lower plate of the first terminal is opposite the lower plate of the second terminal in the lateral direction, and the positional relationship between the upper plate of the first terminal and the upper plate of the second terminal in the lateral direction is opposite the positional relationship between the lower plate of the first terminal and the lower plate of the second terminal in the lateral direction.

10 Claims, 21 Drawing Sheets

(56) References Cited

U.S. PATENT DOCUMENTS

| | | | | |
|---|---|---|---|---|
| 7,341,493 | B2 | 3/2008 | Pepe et al. | |
| 8,167,631 | B2 * | 5/2012 | Ito | H01R 24/38<br>439/108 |

* cited by examiner

CONNECTOR

RELATED APPLICATIONS

This application claims priority to Japanese Application No. 2017-069523, filed Mar. 31, 2017, which is incorporated herein by reference in its entirety.

TECHNICAL FIELD

The present disclosure relates to a connector.

BACKGROUND ART

Computers and communication terminals use connectors with crosstalk reduction means for transmitting high-frequency signals between an apparatus and a communication cable (for example, refer to Patent Document 1).

FIG. 21 is a perspective view illustrating a terminal construction for a known connector.

In FIG. 21, 811 is a terminal holding member attached to a housing used for a communication connector, for example, compliant with RJ-45 standards, which holds eight wire shaped terminals 861*a* to 861*h*. Each of terminals 861*a* to 861*h* comes into contact with each plug connector terminal connected to the tip of a communication cable (not illustrated).

In addition, terminal holding member 811 is equipped with printed board 891. Printed board 891 is equipped with eight conductive via holes formed thereon to which tails 868*a* to 868*h* of terminals 861*a* to 861*h* are inserted and connected, in addition to being equipped with eight connection terminals 851 corresponding to each of terminals 861*a* to 861*h*. Connection terminals 851 come into contact with apparatus side terminals on an apparatus (not illustrated). Each of connection terminals 851 is connected to each via hole through a conductive trace (not illustrated), thereby electrically connecting to tails 868*a* to 868*h* of the corresponding terminals 861*a* to 861*h*.

Terminals 861*a* to 861*h* extending in the anteroposterior direction are arranged side by side, with some of terminals 861*a* to 861*h* crossing each other at crossing region 867 in the middle of the extension. Specifically, terminals 861*a* and 861*b*, terminals 861*d* and 861*e*, and terminals 861*g* and 861*h* cross each other. Arranging crossing region 867 generates couplings to compensate for crosstalk, thereby enabling crosstalk to be reduced.

Patent Document 1: JP2001-118642A

SUMMARY

However, known connectors only interchange the positions of a plurality of wire shaped terminals 861*a* to 861*h* arranged side by side in two dimensions, making it difficult to significantly reduce crosstalk.

The present disclosure aims to provide a solution to the above issue of known connectors by providing a connector which can properly arrange coupling between terminals in order to surely and significantly reduce the effect of crosstalk and noise.

In order to provide the above, a connector includes a housing and a terminal installed in the housing, the terminal includes a pair consisting of a first terminal and a second terminal, both the first terminal and the second terminal include a contact part extending in the anteroposterior direction along with an upper plate and a lower plate extending in the vertical direction and a link section extending in the lateral direction and linking up with the upper plate and the lower plate, the contact part of the first terminal is opposite the contact part of the second terminal in the vertical direction, the upper plate of the first terminal is opposite the upper plate of the second terminal in the lateral direction, the lower plate of the first terminal is opposite the lower plate of the second terminal in the lateral direction, and the positional relationship between the upper plate of the first terminal and the upper plate of the second terminal in the lateral direction is opposite the positional relationship between the lower plate of the first terminal and the lower plate of the second terminal in the lateral direction.

In another connector, the positional relationship between the upper plate of the first terminal and the upper plate of the second terminal as well as the positional relationship between the lower plate of the first terminal and the lower plate of the second terminal in the lateral direction reverse at the link section.

In still another connector, there are multiple pairs of first terminals and second terminals, with the pairs aligned and arranged in the lateral direction.

In still another connector, the edges of the contact parts in one pair and the edges of the contact parts in an adjacent pair face each other in the lateral direction.

In still another connector, the surfaces of the upper plate and the lower plate in one pair and the surfaces of the upper plate and the lower plate in an adjacent pair face each other in the lateral direction.

In still another connector, a pair consisting of the first terminal and the second terminal transmits a differential signal.

In still another connector, the housing includes a housing groove housing the upper plate and the lower plate of the first terminal and the second terminal, wherein a bulge swelling out from at least part of the surface of the upper plate and the lower plate opposite the inner wall of the housing groove is formed.

In still another connector, the housing includes a housing groove housing the upper plate and the lower plate of the first terminal and the second terminal, wherein a bulge swelling out from at least part of the surface of the inner wall of the housing groove opposite the upper plate and the lower plate is formed.

In still another connector, each of the first terminal and the second terminal further include a base connected to the rear section of the lower plate and extending in the vertical direction, along with a tail connected to the bottom end of the base and extending in the anteroposterior direction, wherein the bottom end of the tail is connected to a plate shaped connection pad disposed on the surface of a substrate.

In still another connector, the first terminal further includes a tail connected to the rear end of the upper plate and extending in the anteroposterior direction, while the second terminal further includes a tail connected to the rear end of the lower plate and extending in the anteroposterior direction, and the tails of the first terminal and the second terminal are inserted in the through holes formed on the substrate.

According to the present disclosure, coupling between terminals can be properly arranged and the effect of crosstalk and noise can be surely and significantly reduced.

BRIEF DESCRIPTION OF THE DRAWINGS

FIGS. 16A-C are diagrams illustrating a state in which the terminals are installed in a substrate connector housing in accordance with the second embodiment, wherein FIG. 16A is a rear view of the terminals, FIG. 16B is a rear view of the housing, and FIG. 16C is a rear view of the housing with the terminals installed in the housing.

FIGS. 17A-17C are diagrams illustrating a state in which the terminals are installed in a substrate connector housing in accordance with a third embodiment, wherein FIG. 17A is a rear view of the terminals, FIG. 17B is a rear view of the housing, and FIG. 17C is a rear view of the housing with the terminals installed in the housing.

DETAILED DESCRIPTION OF THE PREFERRED EMBODIMENTS

Embodiments will be described in detail below with reference to the drawings.

Figure 1:
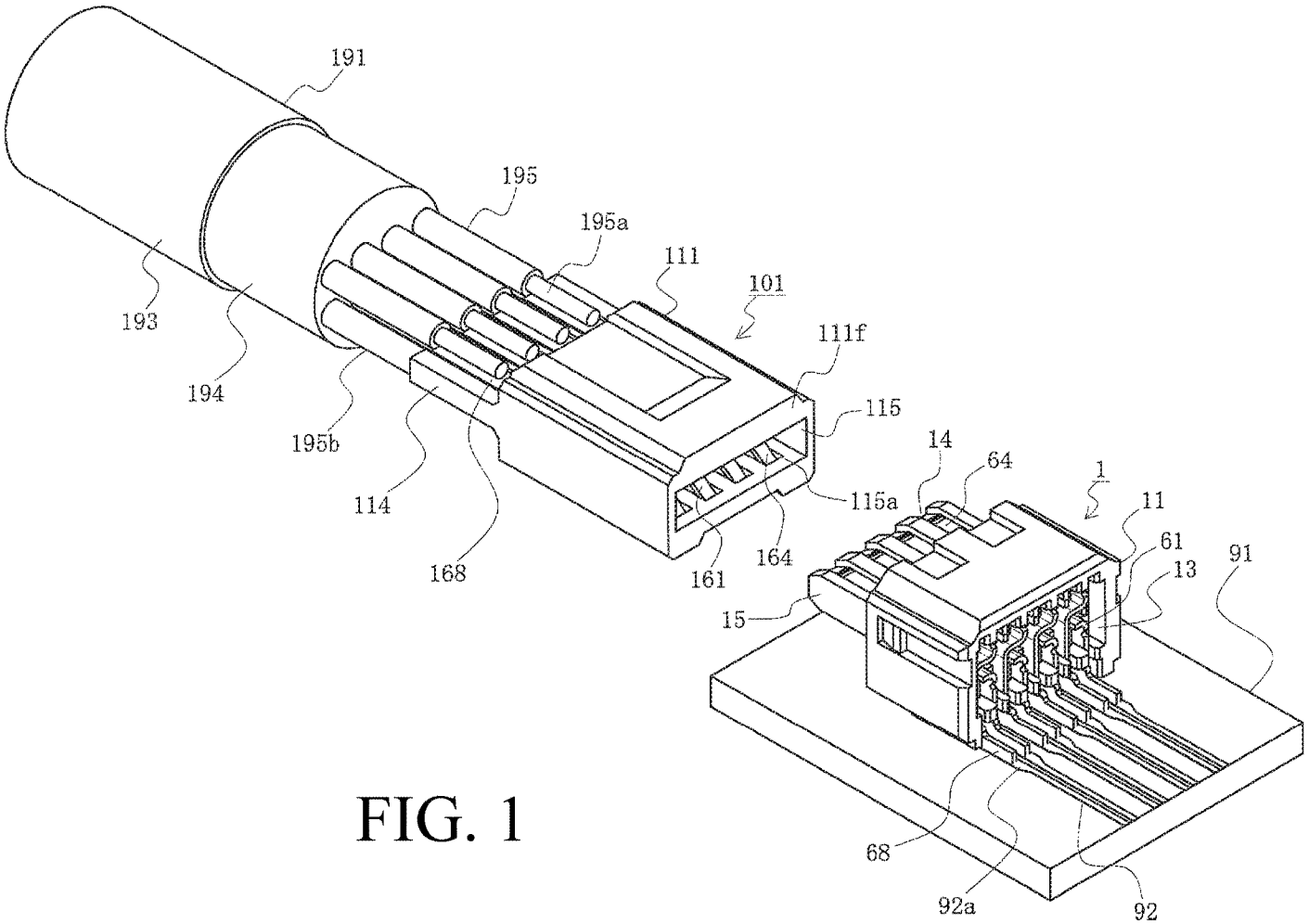
FIG. 1 is a perspective view illustrating a state prior to mating a substrate connector with a wire connector in accordance with a first embodiment.
Figure 2:
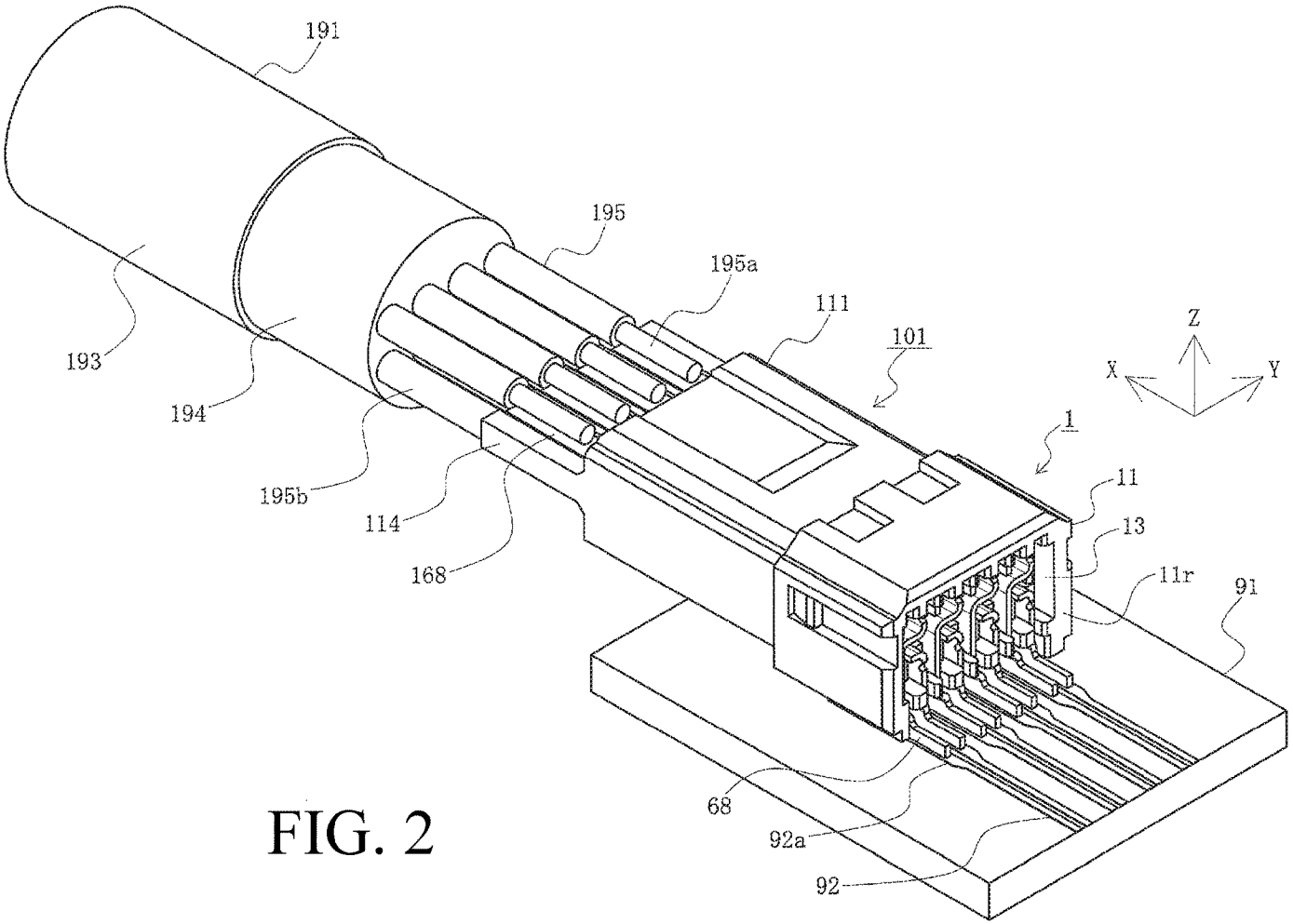
FIG. 2 is a perspective view illustrating a state in which the substrate connector mates with the wire connector in accordance with the first embodiment.

FIG. 1 is a perspective view illustrating a state prior to mating a substrate connector with a wire connector in accordance with a first embodiment, while FIG. 2 is a perspective view illustrating a state in which the substrate connector mates with the wire connector in accordance with the first embodiment.

In the figures, 1 is a substrate connector as a connector in accordance with the first embodiment, which is mounted on substrate 91 such as a printed circuit board included in electrical equipment and electronic equipment, etc. (not illustrated). Further, 101 is a wire connector as a mating connector mating with the substrate connector 1 and is connected to a terminus of cable 191 having a plurality of wires 195. Although cable 191 is a long narrow member in the present embodiment, only the portion close to wire connector 101 is illustrated, with the rest of the whole illustration omitted for the sake of expediency. Further, an illustration of sheathing is also partially omitted.

Substrate connector 1 and wire connector 101, for example, are used in a variety of electronic equipment such as personal computers, workstations, and smartphones, along with a variety of equipment such as household equipment, medical equipment, industrial equipment, and transport equipment, but may be used in any application. Here, for convenience of description, cable 191 includes four pairs of wires, that is, eight wires 195, having an outer diameter of approximately 8 [mm], with wire connector 101 having a length of approximately 31 to 32 [mm] along with a width and height of approximately 10 to 13 [mm]. Eight wires 195 are provided, and each pair of wires 195 functions as a differential signal pair for transmitting differential signals, and, for example, each pair is able to transmit differential signals at communication speeds of approximately 250 [Mbps], totaling communication speeds of approximately 1 [Gbps] for all four pairs.

In the example illustrated in the figures, outermost insulating sheath 193 and inner insulating sheath 194 are removed to expose eight wires 195 in the vicinity of the terminus of cable 191. Further, insulator 195*b* is removed to expose conductive core 195*a* in the vicinity of the terminus of each wire 195. Note that, every four wires 195 are aligned in two rows and the pair of wires 195 opposite in the vertical direction function as a differential signal pair.

Note that the expressions for indicating directions such as up, down, left, right, front, and back, used to describe the operations and configurations of the parts of substrate connector 1 and wire connector 101 in the present embodiment are not absolute but rather relative directions, and though appropriate when the parts of substrate connector 1 and wire connector 101 are in the positions illustrated in the figures, these directions should be interpreted differently when these positions change, in order to correspond to the change.

Substrate connector 1 includes: housing 11 which is integrally formed of an insulating material such as a synthetic resin and mates with wire connector 101; and a plurality of metallic terminals 61 installed in housing 11. Housing 11 is a box shaped member having a substantially rectangular body that extends in the width direction of substrate connector 1, that is, in the lateral direction (Y direction), in the mating direction of wire connector 101, that is, in the anteroposterior direction (X direction), and in the thickness direction of substrate 91, that is, the vertical direction (Z direction). Housing 11 includes tongue shaped section 15 protruding to the front, with a plurality of terminal housing grooves 14 formed on the top and bottom of tongue shaped section 15.

In the example illustrated in the figures, a plurality of terminals 61 are housed in terminal housing hollow 13 formed in an opening manner at rear end 11*r* of housing 11. Although the number of terminals 61 can be freely configured, for the sake of explanation, the number of terminals 61 is set to eight, the same as the number of wires 195. Terminal housing grooves 14 are formed and aligned in fours on the top and bottom of tongue shaped section 15 in conformity with the number of terminals 61, with each of terminal housing grooves 14 housing single contact part 64 of terminal 61. Further, a pair of contact parts 64 opposite in the vertical direction interposing tongue shaped section 15 functions as a differential signal pair. That is, in tongue shaped section 15, four pairs of differential signal pairs are aligned in the lateral direction.

In addition, tails 68 of terminals 61 project backward from rear end 11*r* of housing 11. In the example illustrated in the figures, tails 68 are aligned in the lateral direction and are electrically connected to connection pads 92*a* formed at the end portion of conductive traces 92 disposed on the surface of substrate 91 by means of soldering, etc. Although the number of conductive traces 92 can be freely configured, for the sake of explanation, the number of conductive traces 92 is set to eight, the same as the number of terminals 61. In addition, conductive traces 92 adjacent each other function together as a differential signal pair. That is, conductive traces 92 as a differential signal pair and connection pads 92*a* are aligned in the lateral direction on the surface of substrate 91. Subsequently, tail 68 connected to each connection pad 92*a* functions as a differential signal pair together with adjacent tail 68.

Note that, if necessary, housing 11 can be covered with a shield member made of conductive metallic plates for EMI (Electro-Magnetic Interference) shielding for signals passing through inside thereof.

Wire connector 101 includes mating housing 111 integrally molded with an insulating material such as a synthetic resin, along with a plurality of metallic mating terminals 161 installed in mating housing 111. Mating housing 111 is a box shaped member having a substantially rectangular body that extends in the width direction of wire connector 101, that is, in the lateral direction (Y direction), in the mating direction with substrate connector 1, that is, in the anteroposterior direction (X direction), and in the thickness direction of substrate 91, that is, the vertical direction (Z direction). Further, mating housing 111 includes an opening 115 which opens at front end 111*f*, along with a plurality of terminal housing grooves 115*a* formed on the upper wall and lower wall of opening 115. In the example illustrated in the figures, a plurality of terminal housing grooves 115*a* are formed and aligned in the upper wall and lower wall, with each terminal housing groove 115*a* housing a single mating terminal 161. Although the number of terminal housing grooves 115*a* and mating terminals 161 can be freely configured, for the sake of explanation, both terminal housing groove 115*a* and mating terminal 161 are disposed in the upper wall and lower wall in fours, the same as contact parts 64 of terminals 61. Further, contact part 164 of each mating terminal 161 projects from each terminal housing groove 115*a* toward the inside of opening 115.

In addition, mating housing 111 includes tongue shaped section 114 protruding backward, with every four tails 168 of mating terminal 161 aligned at the top and bottom of tongue shaped section 114. Further, core 195*a* of each wire 195 is electrically connected to each tail 168 by means of soldering, etc. As mentioned, since a pair of wires 195 opposite in the vertical direction functions as a differential signal pair, a pair of mating terminals 161 opposite in the vertical direction also functions as a differential signal pair.

Note that, if necessary, the entire area close to the terminus of cable 191 can be covered with insulating sheathes such as outermost insulating sheath 193 and inner insulating sheath 194, while the area close to termination cable 191 and mating housing 111 can be covered with a shield member made of conductive metallic plates for EMI shielding for signals passing through inside thereof.

Consequently, as illustrated in FIG. 2, when substrate connector 1 mates with wire connector 101, tongue shaped section 15 of housing 11 is housed in opening 115 of mating housing 111, each contact part 64 of the terminal 61 comes in contact with the corresponding contact part 164 of mating terminal 161, and substrate connector 1 and wire connector 101 conduct each other. The above brings conductive traces 92 and wires 195 into conduction.

Next, the configuration of substrate connector 1 will be explained in detail.

Figure 3:
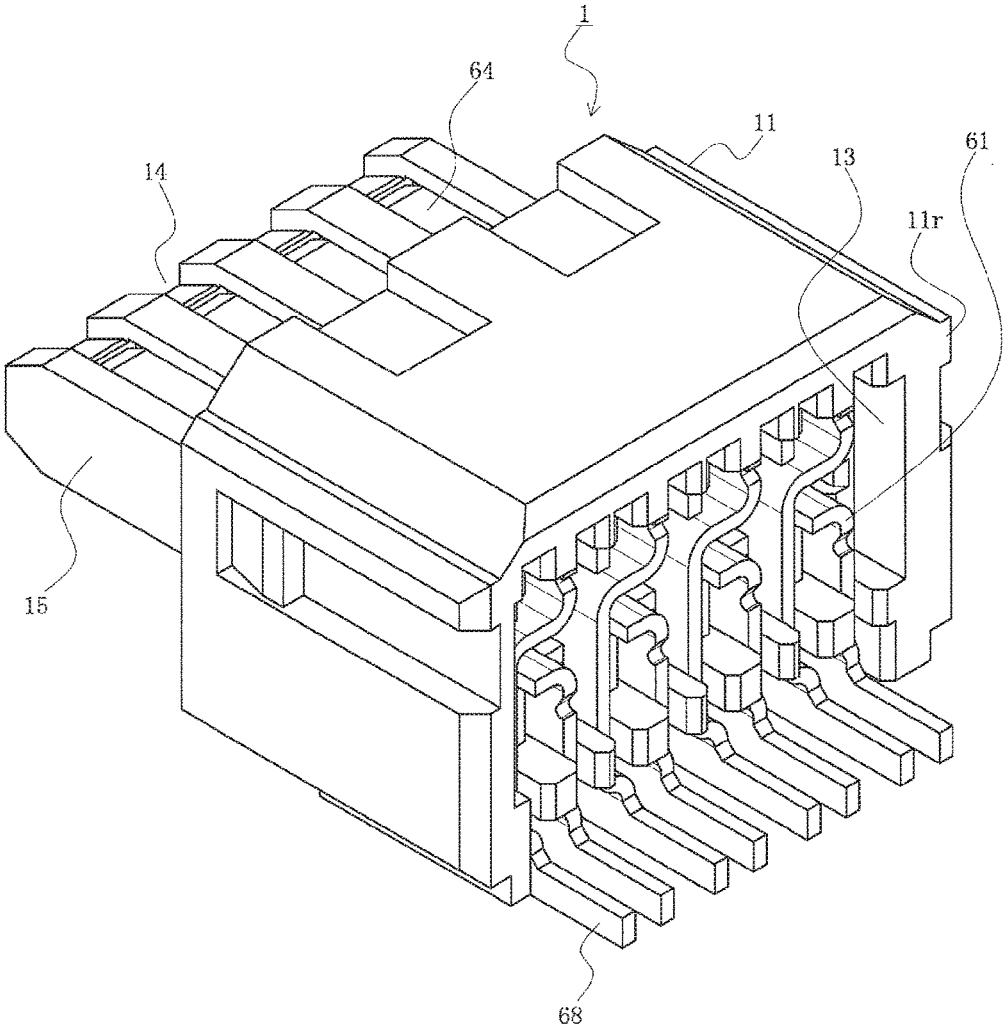
FIG. 3 is a perspective view of the substrate connector in accordance with the first embodiment.
Figure 4:
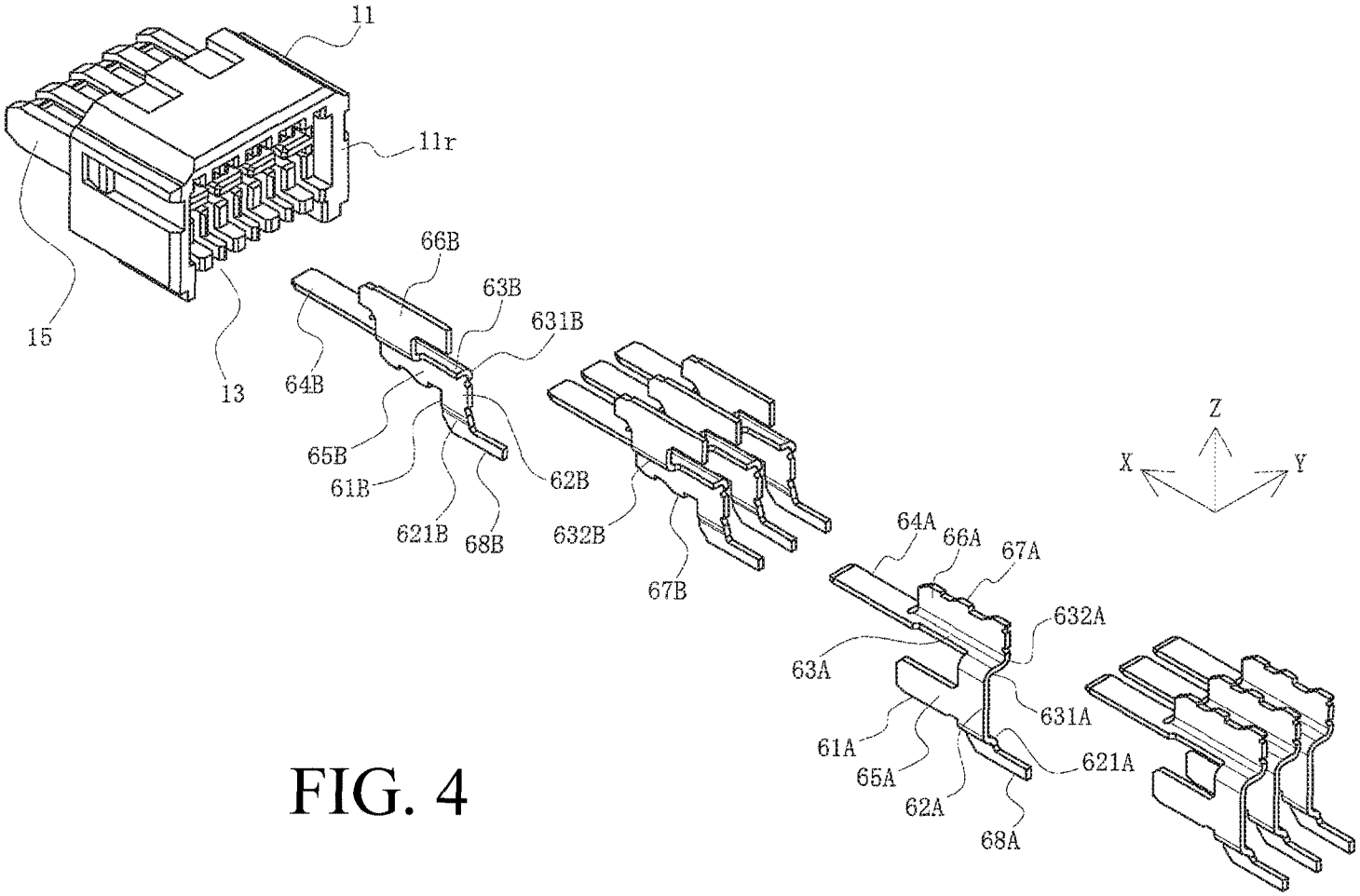
FIG. 4 is an exploded view of the substrate connector in accordance with the first embodiment.
Figure 5:
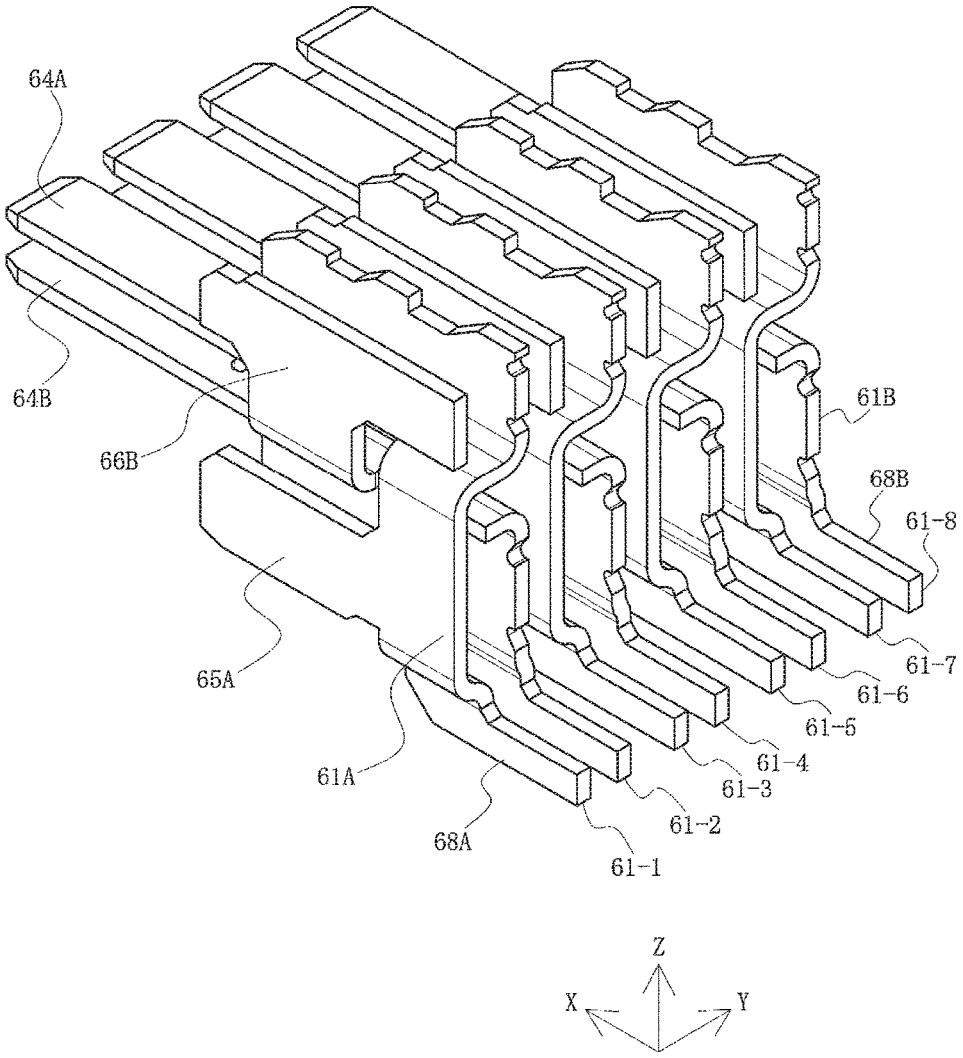
FIG. 5 is a perspective view illustrating an arrangement of substrate connector terminals in accordance with the first embodiment.
Figure 6:
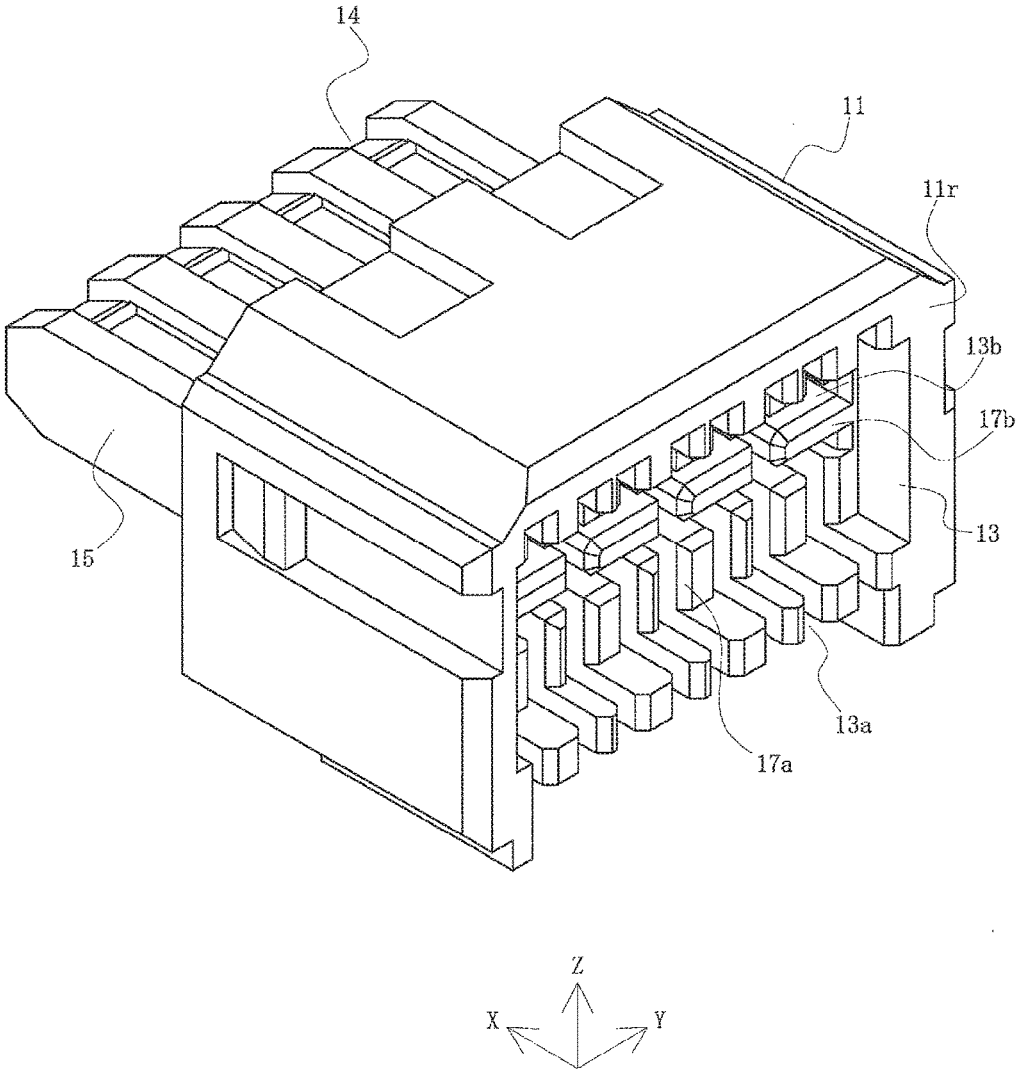
FIG. 6 is a perspective view of a housing of the substrate connector in accordance with the first embodiment.
Figure 7:
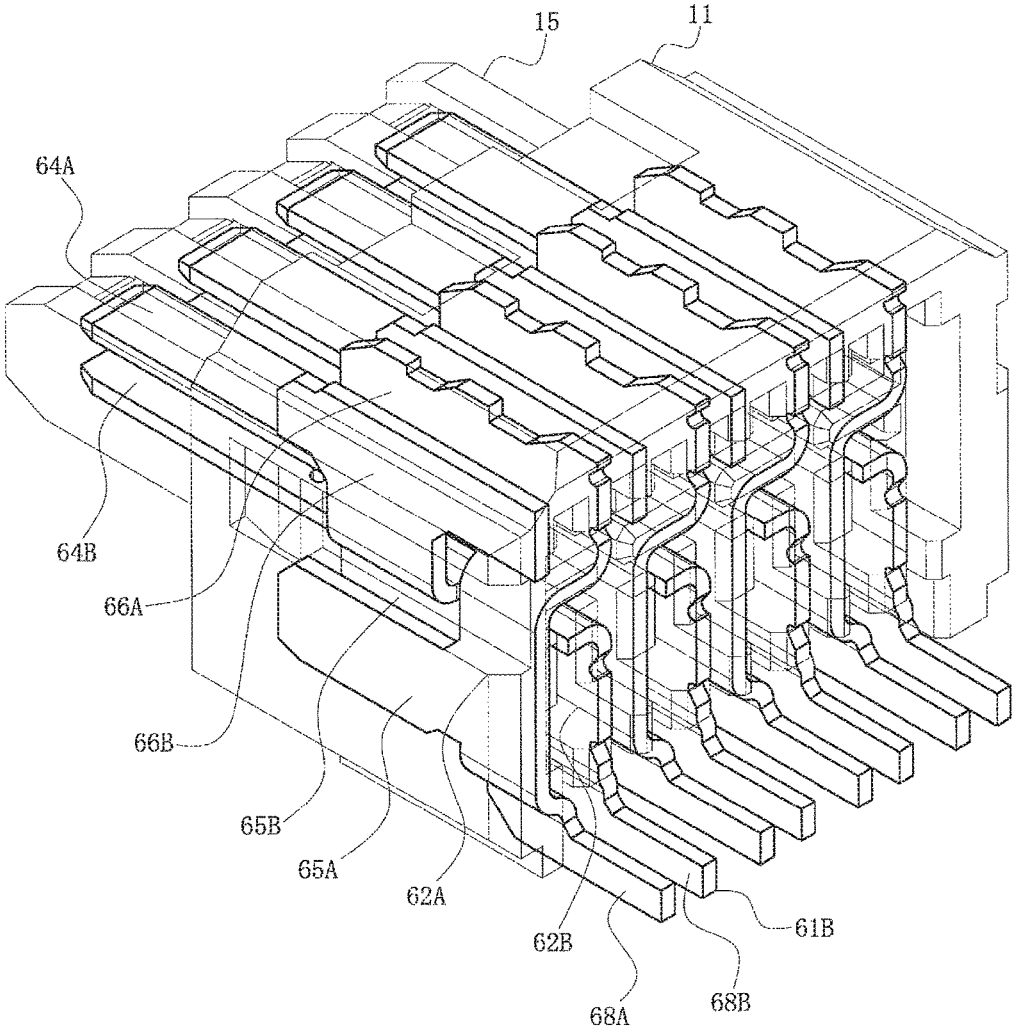
FIG. 7 is an opened up view illustrating an arrangement of the terminals installed in a housing of the substrate connector in accordance with the first embodiment.
Figure 8:
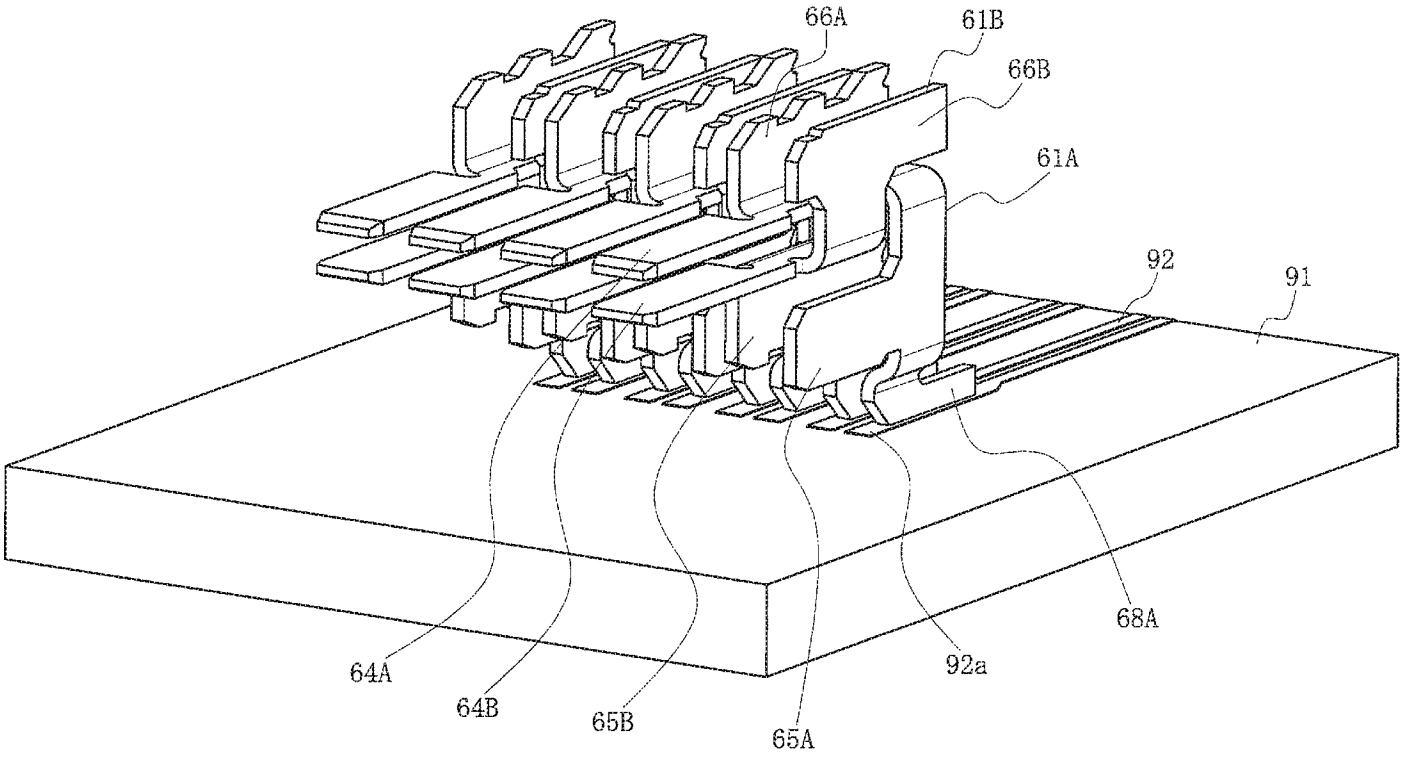
FIG. 8 is a first perspective view illustrating a state in which substrate connector terminals are mounted on a substrate in accordance with the first embodiment.
Figure 9:
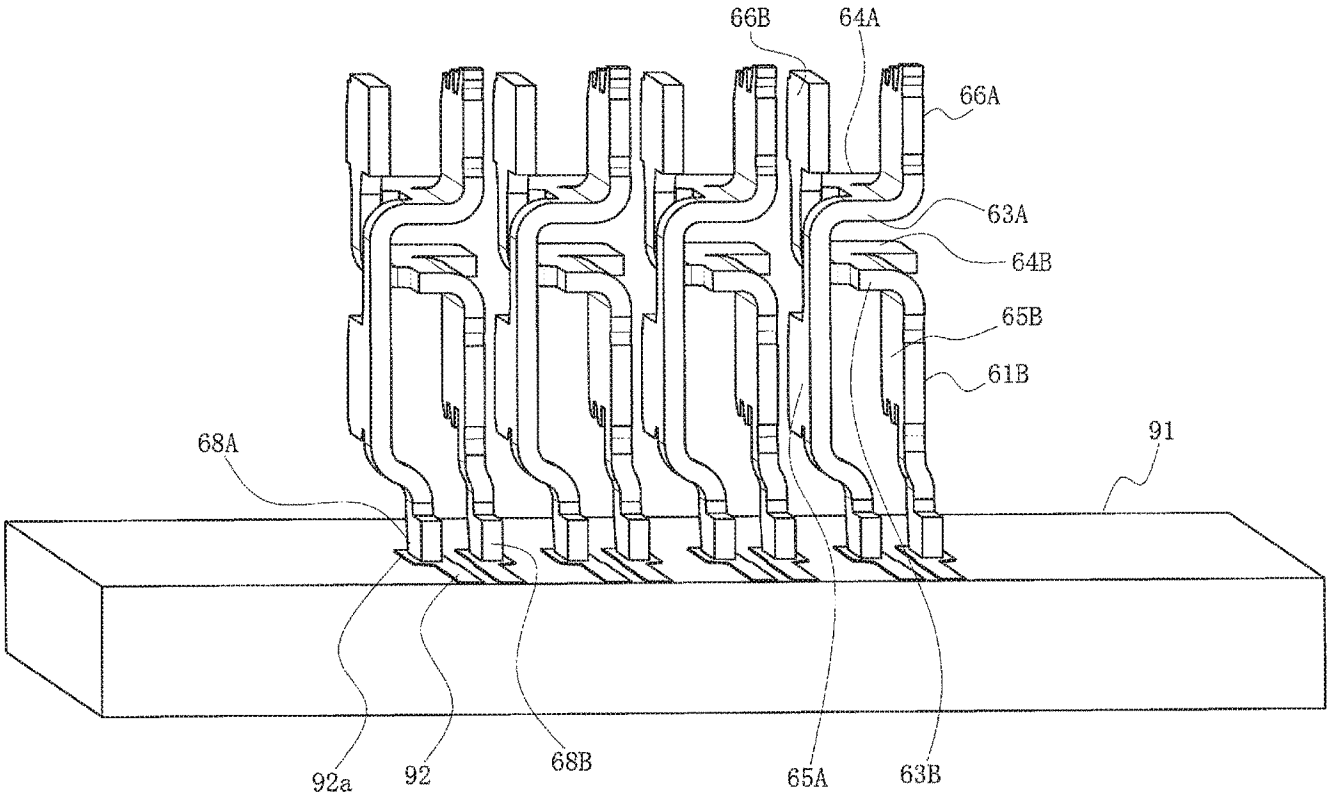
FIG. 9 is a second perspective view illustrating a state in which the substrate connector terminals are mounted on the substrate in accordance with the first embodiment.

FIG. 3 is a perspective view of the substrate connector in accordance with the first embodiment. FIG. 4 is an exploded view of the substrate connector in accordance with the first embodiment. FIG. 5 is a perspective view illustrating an arrangement of substrate connector terminals in accordance with the first embodiment. FIG. 6 is a perspective view of a housing of the substrate connector in accordance with the first embodiment. FIG. 7 is an opened up view illustrating an arrangement of the terminals installed in a housing of the substrate connector in accordance with the first embodiment. FIG. 8 is a first perspective view illustrating a state in which substrate connector terminals are mounted on a substrate in accordance with the first embodiment. FIG. 9 is a second perspective view illustrating a state in which the substrate connector terminals are mounted on the substrate in accordance with the first embodiment.

In the present embodiment, terminals 61 are preferably formed by punching and bending work on a metallic plate and include a plurality of pairs each including two kinds which are first terminal 61A and second terminal 61B as illustrated in FIGS. 4 and 5. The pair including first terminal 61A and second terminal 61B is a differential signal pair transmitting differential signals and are aligned in the Y direction as the lateral direction and installed in housing 11. For example, as illustrated in FIG. 5, when allocating numbers 1 to 8 from left to right to the eight terminals 61 installed in housing 11, terminals 61 are aligned such that terminals 61-1, 61-3, 61-5 and 61-7 having an odd number are first terminal 61A, with terminals 61-2, 61-4, 61-6 and 61-8 having an even number being second terminal 61B. Note that, in the explanations for terminals 61 and for each section of terminals 61, symbols A and B are allocated when identifying the kind and are not allocated when providing an integrated explanation.

First terminal 61A includes base 62A which extends in the Z direction as the vertical direction (longitudinal direction) and in the X direction as the anteroposterior direction, horizontal section 63A which is connected to the top end of base 62A and extends in the Y and X directions, and contact part 64A which is connected to the front end of horizontal section 63A and extends in the Y and X directions. First terminal 61A further includes upper coupling adjuster 66A as an upper plate which is connected to horizontal section 63A at the end opposite the end to which base 62A is connected, and extends in the Z and X directions, lower coupling adjuster 65A as a lower plate which is connected to the front end of base 62A and extends in the Z and X directions, and tail 68A which is connected to the bottom end of base 62A and extends in the Z and X directions. Base 62A and lower coupling adjuster 65A are positioned in the same plane, while horizontal section 63A and contact part 64A are positioned in the same plane. Base 62A, upper coupling adjuster 66A, and lower coupling adjuster 65A, all of which extend in the Z direction, can be referred to as the vertical section, while horizontal section 63A and contact part 64A, both of which are positioned in the same plane, can be referred to as the horizontal section. Note that, locking projection 67A is formed on the top end of upper coupling adjuster 66A for digging into the wall surface of terminal housing hollow 13 in housing 11 to lock upper coupling adjuster 66A.

Since tail 68A is connected to base 62A through tail offset section 621A having a crank shape when viewed from the X direction, the position of tail 68A is offset in the positive Y direction to base 62A. Further, since upper coupling adjuster 66A is connected to base 62A through horizontal section 63A, the position of upper coupling adjuster 66A is offset in the positive Y direction to base 62A and lower coupling adjuster 65A. Here, a link section links up with horizontal section 63A, left connecting section 631A connecting horizontal section 63A with base 62A, and right connecting section 632A connecting horizontal section 63A with upper coupling adjuster 66A. The link section links up with upper coupling adjuster 66A and lower coupling adjuster 65A and functions as a coupling arranging offset section which has a crank shape when viewed from the X direction and offsets upper coupling adjuster 66A and lower coupling adjuster 65A with each other in the Y direction. Further, the coupling arranging offset section as the link section provides an amount of offset larger than the amount of offset provided by tail offset section 621A. That is, the amount of offset of upper coupling adjuster 66A is larger than the amount of offset of tail 68A to base 62A and lower coupling adjuster 65A in the positive Y direction.

Further, second terminal 61B includes base 62B which extends in the Z and X directions, horizontal section 63B which is connected to the top end of base 62B and extends in the Y and X directions, and contact part 64B which is connected to the front end of horizontal section 63B and extends in the Y and X directions. Second terminal 61B further includes an upper coupling adjuster 66B as an upper plate which is connected to horizontal section 63B at the end opposite the end to which base 62B is connected, and extends in the Z and X directions, lower coupling adjuster 65B as a lower plate which is connected to the front end of base 62B and extends in the Z and X directions, and tail 68B which is connected to the bottom end of base 62B and extends in the Z and X directions. Base 62B and lower coupling adjuster 65B are positioned in the same plane, while horizontal section 63B and contact part 64B are positioned in the same plane. Base 62B, upper coupling adjuster 66B and lower coupling adjuster 65B, each of which extend in the Z direction, can be referred to as the vertical section, while horizontal section 63B and contact part 64B, both of which are positioned in the same plane, can be referred to as the horizontal section. Note that, locking projection 67B is formed at the bottom end of lower coupling adjuster 65B for digging into the wall surface of terminal housing hollow 13 in housing 11 to lock lower coupling adjuster 65B.

Since tail 68B is connected to base 62B through tail offset section 621B having a crank shape when viewed from the X direction, the position of tail 68B is offset in the positive Y direction to base 62B. Further, since upper coupling adjuster 66B is connected to base 62B through horizontal section 63B, the position of upper coupling adjuster 66B is offset in the negative Y direction to base 62B and lower coupling adjuster 65B. Here, a link section links up with horizontal section 63B, right connecting section 631B connecting horizontal section 63B with base 62B, and left connecting section 632B connecting horizontal section 63B with upper coupling adjuster 66B. The link section links up with upper coupling adjuster 66B and lower coupling adjuster 65B, and further functions as a coupling arranging offset section which has a crank shape when viewed from the X direction and offsets upper coupling adjuster 66B and lower coupling adjuster 65B with each other in the Y direction. Further, the direction of the offset provided by the coupling arranging offset section as the link section is opposite the direction of the offset provided by tail offset section 621B. That is, the position of tail 68B is offset in the positive Y direction to base 62B and lower coupling adjuster 65B. On the contrary, the position of upper coupling adjuster 66B is offset in the negative Y direction to base 62B and lower coupling adjuster 65B. In other words, in second terminal 61B, although tail 68B is offset in the direction identical to the direction in which tail 68A of first terminal 61A is offset, upper coupling adjuster 66B is offset in the direction opposite the direction in which upper coupling adjuster 66A of first terminal 61A is offset.

Further, the distance from the bottom end of tail 68B to horizontal section 63B and contact part 64B in second terminal 61B is shorter than the distance from the bottom end of tail 68A to horizontal section 63A and contact part 64A in first terminal 61A. That is, the positions of horizontal section 63B, contact part 64B, and the coupling arranging offset section in second terminal 61B are lower than the positions of horizontal section 63A, contact part 64A, and the coupling arranging offset section in first terminal 61A, respectively. Further, the distance from the front end of contact part 64B to left connecting section 632B connecting horizontal section 63B with upper coupling adjuster 66B in second terminal 61B is shorter than the distance from the front end of contact part 64A to left connecting section 631A connecting horizontal section 63A with base 62A in first terminal 61A. That is, in second terminal 61B, the position of left connecting section 632B connecting horizontal section 63B with upper coupling adjuster 66B is placed forward compared with the position of left connecting section 631A connecting horizontal section 63A with base 62A in first terminal 61A.

As illustrated in FIG. 6, a plurality of vertical walls 17*a* extending in the Z and X directions and a plurality of lateral walls 17*b* extending in the Y and X directions are disposed in terminal housing hollow 13 of housing 11. Further, vertical grooves 13*a* as a plurality of housing grooves extending in the Z and X directions, and lateral grooves 13*b* as a plurality of housing grooves extending in the Y and X directions, are formed between vertical walls 17*a* and lateral walls 17*b*. Note that, lateral groove 13*b* is communicatively connected to terminal housing groove 14 formed on the top and bottom of tongue shaped section 15. In addition, terminals 61 are moved backward to forward in housing 11 and are housed and installed in terminal housing hollow 13 such that the vertical section is inserted in vertical groove 13*a*, while the horizontal section is inserted in lateral groove 13*b*.

Specifically, as illustrated in FIG. 4, second terminal 61B is first housed and installed in terminal housing hollow 13, then first terminal 61A is housed and installed in terminal housing hollow 13. Subsequently, as illustrated in FIG. 3, once all terminals 61 have been installed, contact part 64 housed in terminal housing groove 14, the vertical section housed in vertical groove 13*a*, the horizontal section housed in lateral groove 13*b*, and only tail 68 protrude backward from rear end 11*r* of housing 11.

FIG. 5 and FIGS. 7 to 9 illustrate the positional relationship between terminals 61 installed in housing 11. Note that, for the sake of explanation, housing 11 is not illustrated in FIG. 5 but rather drawn in fine line in FIG. 7. Further, housing 11 is not illustrated, with only terminals 61 mounted on substrate 91 illustrated when viewed from the diagonally forward direction in FIG. 8. Further, housing 11 is not illustrated, with only terminals 61 mounted on substrate 91 illustrated when viewed from the diagonally backward direction in FIG. 9.

As described the above, tails 68 adjacent to each other function as a differential signal pair. That is, as illustrated in FIG. 5, each pair of terminals adjacent to each other such as terminals 61-1 and 61-2, terminals 61-3 and 61-4, terminals 61-5 and 61-6, and terminals 61-7 and 61-8 function as a differential signal pair.

Further, the horizontal sections of terminals 61 adjacent to each other form an opposing pair in the vertical direction, that is, the Z direction. For example, regarding the pair of terminals 61-1 and 61-2, a pair of the contact parts 64A in terminals 61-1 as first terminal 61A and contact part 64B in terminals 61-2 as second terminal 61B which are opposite in the Z direction interposing tongue shaped section 15, functions as a differential signal pair.

Further, vertical sections of terminals 61 adjacent to each other cross each other. That is, the positional relationship in the Y direction changes the locations between left and right above and under the coupling arranging offset section. For example, regarding the pair of terminals 61-1 and 61-2, lower coupling adjuster 65A in terminals 61-1 as first terminal 61A is positioned in the left of lower coupling adjuster 65B in terminals 61-2 as second terminal 61B. On the other hand, upper coupling adjuster 66A in terminals 61-1 is positioned in the right of upper coupling adjuster 66B in terminals 61-2.

The above enables each pair of terminals 61 to significantly and surely reduce the effect of crosstalk, noise, etc. by adjacent pairs of terminals 61. For example, regarding the pair of terminals 61-1 and 61-2, the edge of contact part 64B in the terminal 61-2 is adjacent and opposite in the Y direction to the edge of contact part 64B in terminals 61-4 in the adjacent pair, terminals 61-3 and 61-4. Thus, terminal 61-2 is affected by crosstalk, noise, etc. generated by contact part 64B in terminals 61-4. Coupling of contact parts 64 adjacent in the Y direction is so-called edge coupling, wherein the coupling strength of the edge coupling is not strong compared with so-called broadside coupling. However, since contact part 64 is long in the X direction, the range of coupling is broad, strengthening the coupling strength as a whole. Here, "coupling" refers to capacitive coupling and inductive coupling. Consequently, signals transmitted by terminals 61-2 are significantly affected by crosstalk, noise, etc. generated by terminals 61-4. However, since the vertical sections of terminals 61 adjacent each other change the locations between left and right above and under the coupling arranging offset section, the side of upper coupling adjuster 66A in terminals 61-1 is adjacent to and opposite the side of upper coupling adjuster 66B in terminals 61-4 in the Y direction. Since coupling of upper coupling adjusters 66 adjacent each other in the Y direction is so-called broadside coupling, the coupling strength is strong even though upper coupling adjuster 66 is short in the X direction. Consequently, signals transmitted by terminals 61-1 are significantly affected by crosstalk, noise, etc. generated by terminals 61-4 as well. Here, the pair of terminals 61-1 and 61-2 is a differential signal pair, such that the effect of terminals 61-4 on the signals transmitted by terminals 61-2 and the effect of terminals 61-4 on the signals transmitted by terminals 61-1 compensate each other. Thus, the pair of terminals 61-1 and 61-2 is minimally affected by the adjacent pair of terminals 61-3 and 61-4.

Note that, since lower coupling adjuster 65A in terminals 61-3 is interposed between lower coupling adjuster 65B in terminals 61-2 and lower coupling adjuster 65B in terminals 61-4, lower coupling adjuster 65B in terminals 61-2 is not directly coupled to lower coupling adjuster 65B in terminals 61-4.

Further, the coupling strength of upper coupling adjusters 66 adjacent each other in the Y direction can be properly arranged by changing the following: the area of the side of upper coupling adjuster 66; the interval between upper coupling adjusters 66; and the non-dielectric constant and thickness, etc. of vertical wall 17*a* of housing 11 intervening between upper coupling adjusters 66.

Further, as described above, the amount of offset of tail 68A in first terminal 61A in the Y direction provided by tail offset section 621A is different from the amount of offset of tail 68B in second terminal 61B in the Y direction provided by tail offset section 621B. By virtue of the above, as illustrated in FIGS. 1 and 2, the distance in the Y direction between tail 68 of a differential signal pair and tail 68 of an adjacent differential signal pair, along with the distance between conductive trace 92 of a differential signal pair and conductive trace 92 of an adjacent differential signal pair can be larger than the distance in the Y direction between tails 68 and between conductive traces 92 in a single differential signal pair. That is, for example, the distance in the Y direction between tail 68 in the terminal 61-2 and tail 68 in the terminal 61-3 can be larger than the distance in the Y direction between tail 68 in terminal 61-1 and tail 68 in terminal 61-2. Further, the distance in the Y direction between conductive trace 92 connected to tail 68 in terminals 61-2 and conductive trace 92 connected to tail 68 in terminals 61-3 can be larger than the distance in the Y direction between conductive trace 92 connected to tail 68 in terminals 61-1 and conductive trace 92 connected to tail 68 in terminals 61-2. Thus, not only the effect of crosstalk, noise, etc. by an adjacent pair of terminals 61, but also the effect of crosstalk, noise, etc. by an adjacent pair of conductive traces 92 can be significantly and surely reduced.

Next, the configuration of wire connector 101 will be explained in detail.

Figure 10:
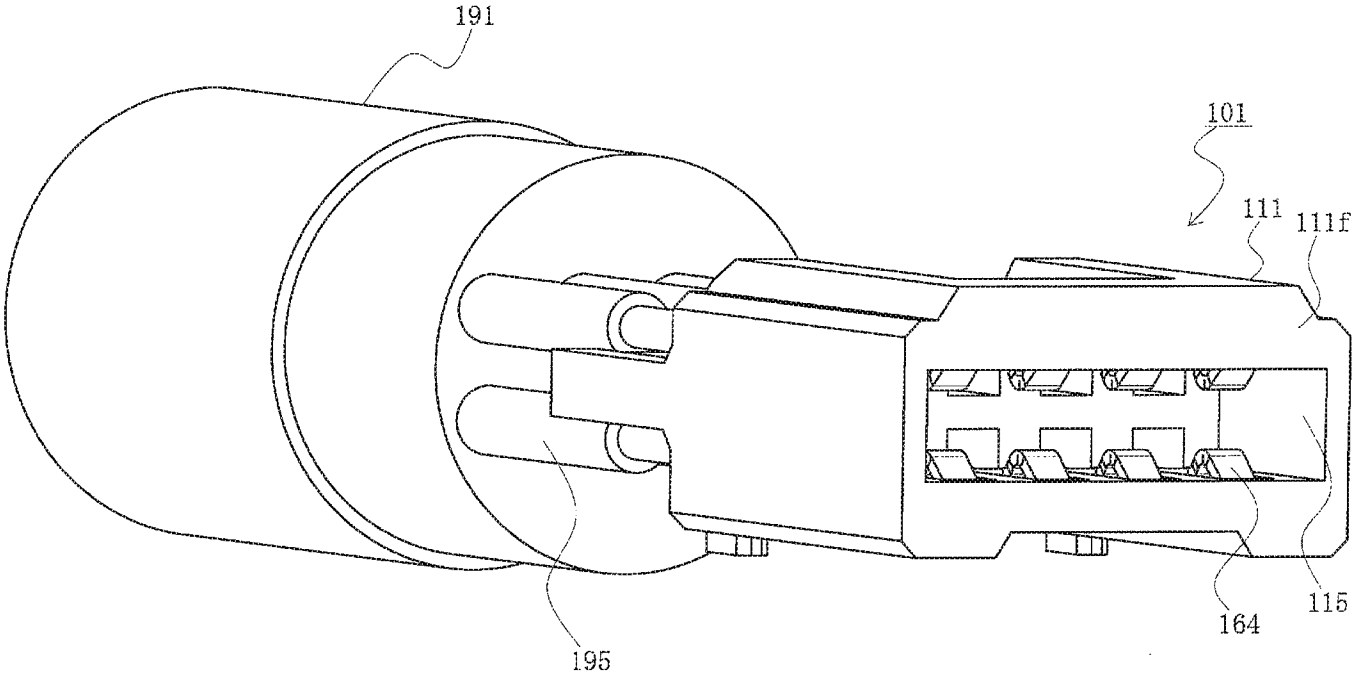
FIG. 10 is a perspective view of the wire connector in accordance with the first embodiment.
Figure 11:
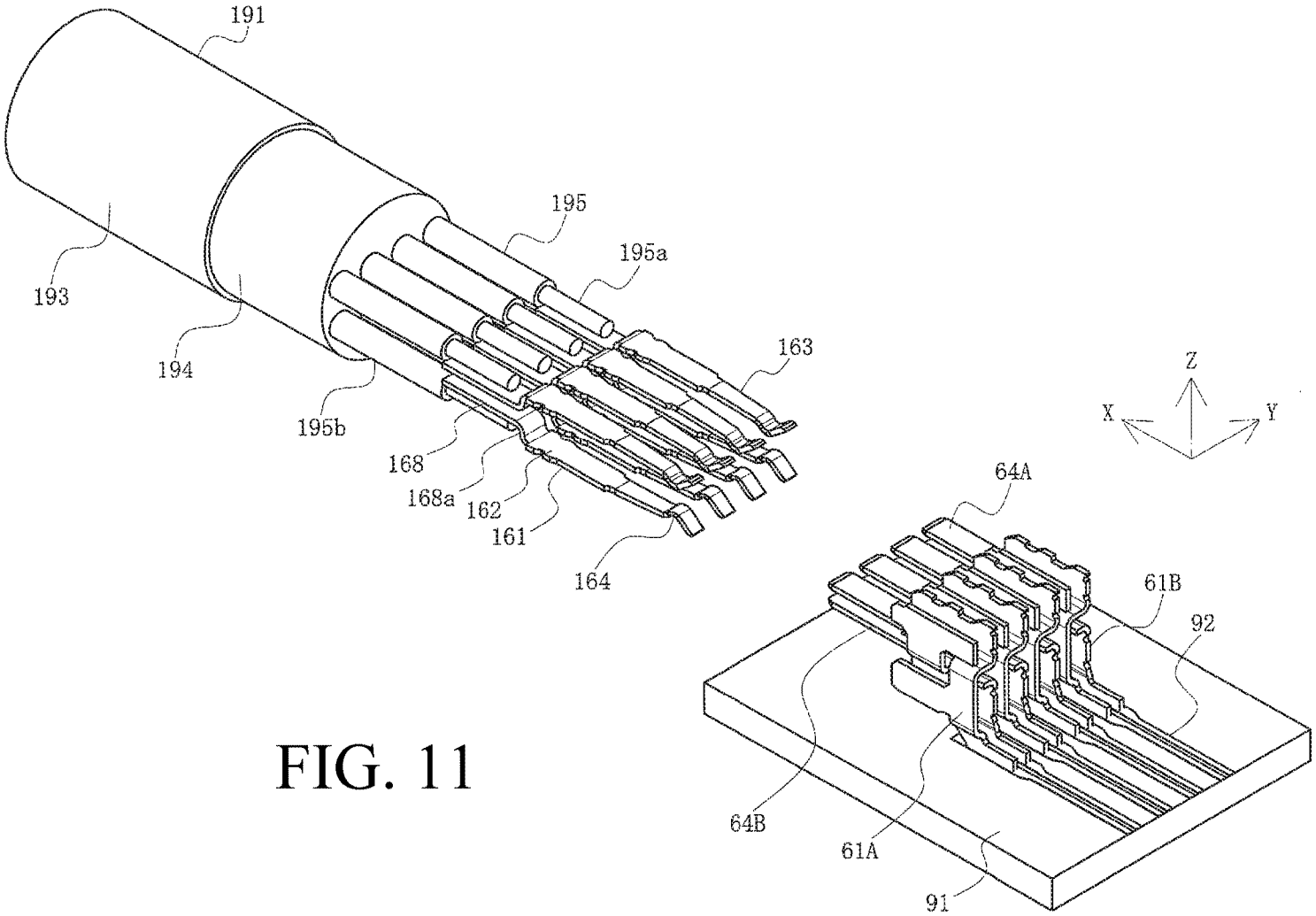
FIG. 11 is a perspective view illustrating an arrangement of wire connector terminals in a state prior to mating with the substrate connector in accordance with the first embodiment.
Figure 12:
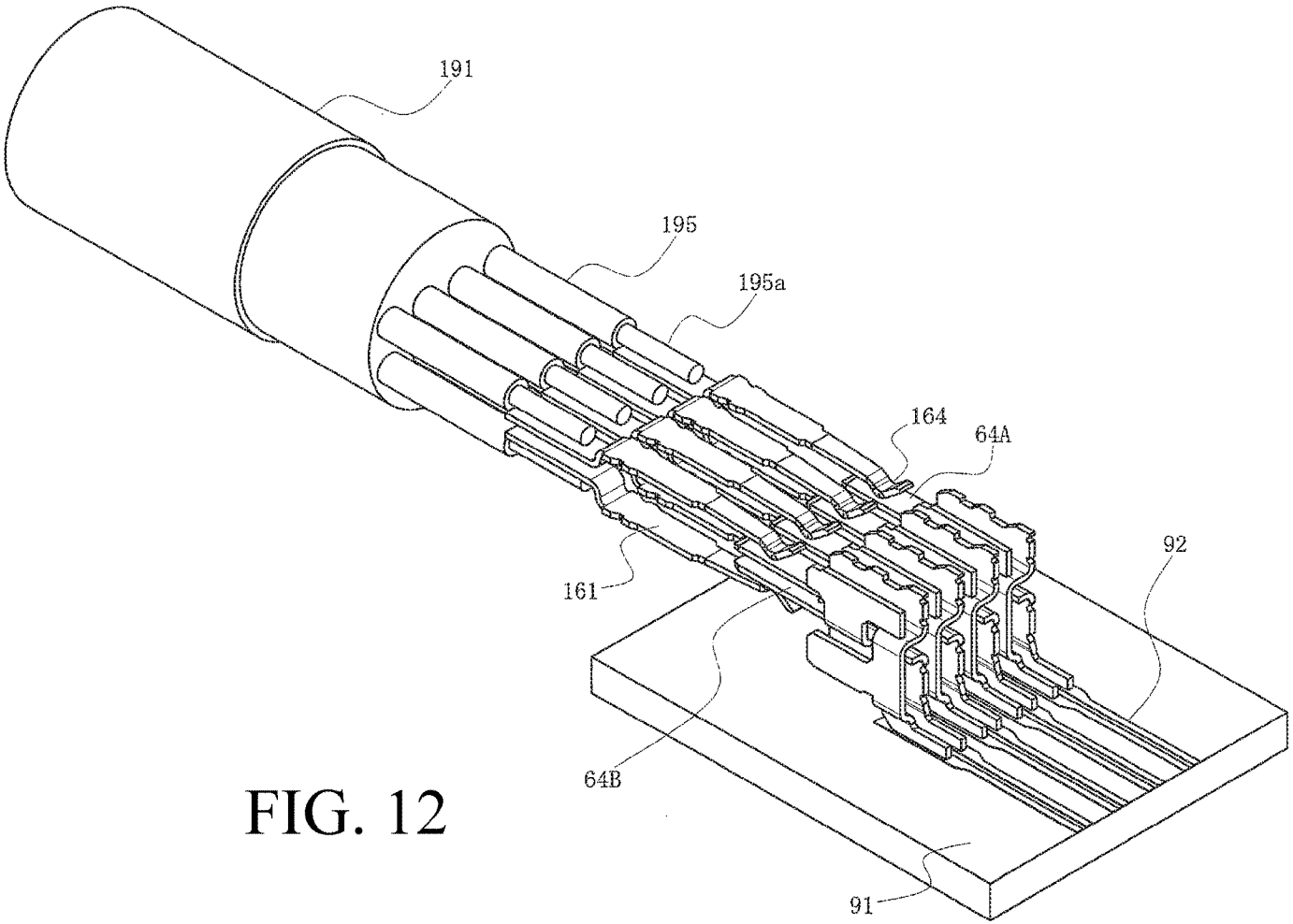
FIG. 12 is a perspective view illustrating an arrangement of wire connector terminals in a state mating with the substrate connector in accordance with the first embodiment.
Figure 13:
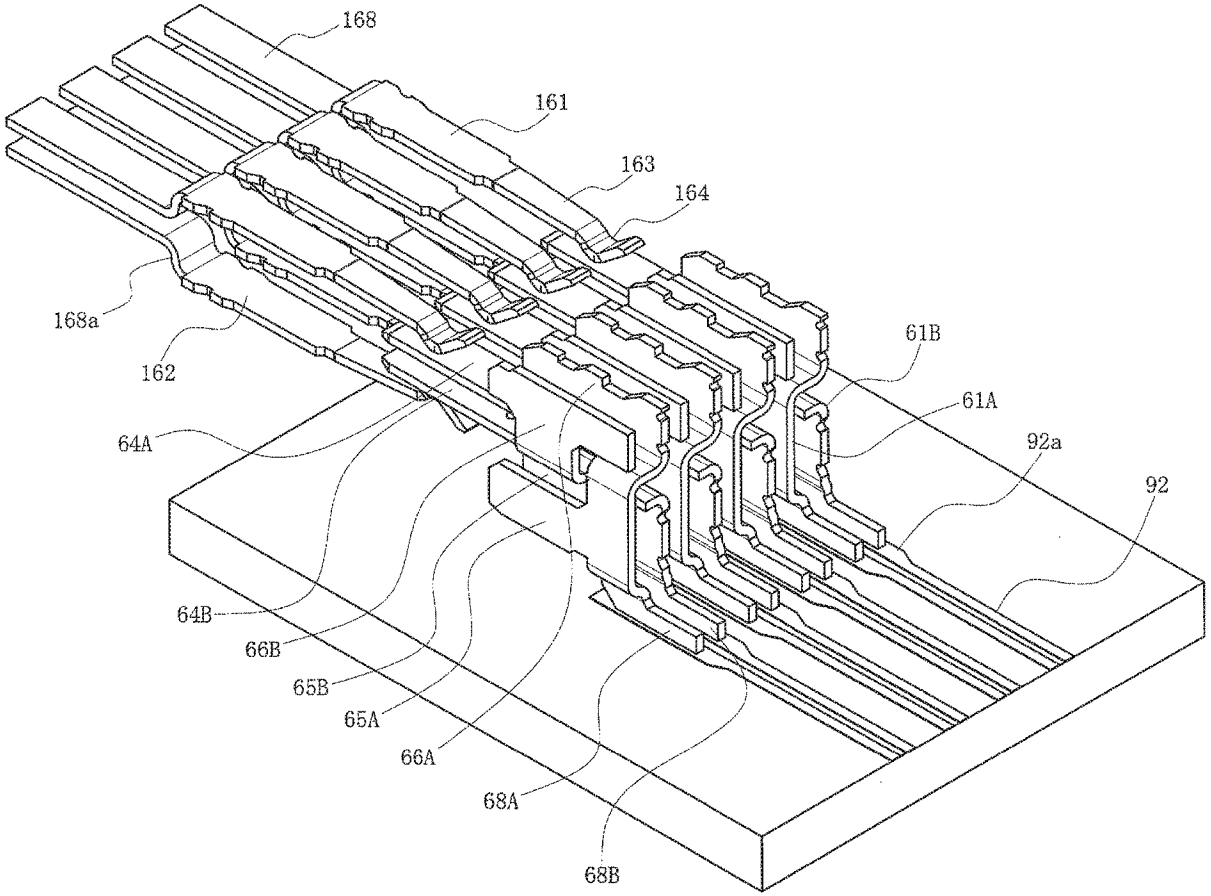
FIG. 13 is a perspective view illustrating a state in which wire connector terminals come into contact with the substrate connector terminals in accordance with the first embodiment.

FIG. 10 is a perspective view of the wire connector in accordance with the first embodiment. FIG. 11 is a perspective view illustrating an arrangement of wire connector terminals in a state prior to mating with the substrate connector in accordance with the first embodiment. FIG. 12 is a perspective view illustrating an arrangement of wire connector terminals in a state mating with the substrate connector in accordance with the first embodiment. FIG. 13 is a perspective view illustrating a state in which wire connector terminals contact the substrate connector terminals in accordance with the first embodiment.

In the present embodiment, mating terminals 161 are preferably formed by punching and bending metallic plates and are aligned in two rows in the Y direction and installed in mating housing 111 as illustrated in FIGS. 11 to 13. Note that, mating terminals 161 in an upper row and a lower row are opposite each other and function as a differential signal pair.

Each mating terminal 161 includes a base 162 extending in the X and Y directions, long narrow arm 163 connected to the front end of base 162, contact part 164 connected to the front end of arm 163, and tail 168 connected to the rear end of base 162 through tail offset section 168*a*. Base 162 is fixed to mating housing 111. Further, each of four tails 168 are disposed at the top and bottom of tongue shaped section 114 in mating housing 111 and are electrically connected to cores 195*a* of each wire 195 by means of soldering, etc. Further, arm 163 functions as a leaf spring and applies energy to contact part 164, projecting contact part 164 into opening 115 as illustrated in FIG. 10.

Consequently, when substrate connector 1 mates with wire connector 101, contact part 164 of mating terminal 161 comes into contact with the corresponding contact part 64 of terminal 61 and is brought into conduction. The above brings conductive traces 92 and wires 195 into conduction. In the above, since the energy applied by arm 163 causes contact parts 164 to interpose contact parts 64 disposed at the top and bottom of tongue shaped section 15 in housing 11 from above and below, continuity between mating terminal 161 and terminals 61 is surely maintained.

As described above, in the present embodiment, substrate connector 1 includes housing 11 and terminals 61 installed in housing 11. In addition, terminals 61 include a pair consisting of first terminal 61A and second terminal 61B. First terminal 61A and second terminal 61B includes contact parts 64A and 64B extending in the X direction, respectively. First terminal 61A and second terminal 61B further include upper coupling adjuster 66A and 66B, along with lower coupling adjuster 65A and 65B all extending in the Z direction, respectively. First terminal 61A and second terminal 61B further include the link section extending in the Y direction which links up with upper coupling adjuster 66A and 66B and lower coupling adjuster 65A and 65B, respectively. Here, the link section includes horizontal section 63A and 63B, left connecting section 631A and 632B, and right connecting section 632A and 631B, respectively. Further, contact part 64A of first terminal 61A is opposite contact part 64B of second terminal 61B in the Z direction, upper coupling adjuster 66A of first terminal 61A is opposite upper coupling adjuster 66B of second terminal 61B in the Y direction, and lower coupling adjuster 65A of first terminal 61A is opposite lower coupling adjuster 65B of second terminal 61B in the Y direction. The positional relationship in the Y direction between upper coupling adjuster 66A of first terminal 61A and upper coupling adjuster 66B of second terminal 61B is opposite the positional relationship in the lateral direction between lower coupling adjuster 65A of first terminal 61A and lower coupling adjuster 65B of second terminal 61B.

As a result, coupling between terminals 61 can be properly arranged and the effect of crosstalk, noise, etc. can be significantly and surely reduced.

Further, the positional relationship in the Y direction between upper coupling adjuster 66A of first terminal 61A and upper coupling adjuster 66B of second terminal 61B, along with the positional relationship in the Y direction between lower coupling adjuster 65A of first terminal 61A and lower coupling adjuster 65B of second terminal 61B, reverse at the link section. In addition, first terminal 61A and second terminal 61B further include base 62A and 62B connected to the rear section of lower coupling adjuster 65A and 65B, with both extending in the vertical direction, respectively. Further, first terminal 61A and second terminal 61B further include tail 68A and 68B connected to the bottom end of base 62A and 62B, with both extending in the anteroposterior direction, respectively. The bottom end of tail 68A and 68B are connected to plate shaped connection pads 92*a* disposed on the surface of substrate 91.

Further, a plurality of pairs of first terminal 61A and second terminal 61B exist and are aligned in the Y direction. Further, the edges of contact part 64A and 64B in one pair are opposite edges of contact part 64A and 64B in adjacent pairs in the Y direction. Further, the surfaces of upper coupling adjuster 66A and 66B and lower coupling adjuster 65A and 65B in one pair and the surfaces of upper coupling adjuster 66A and 66B and lower coupling adjuster 65A,65B of adjacent pairs face each other in the Y direction. Further, the pair of first terminal 61A and second terminal 61B transmits differential signals.

Thus, the pair of first terminal 61A and second terminal 61B can significantly and surely reduce the effect of crosstalk, noise, etc. from adjacent pairs.

Next a second embodiment will be described. Note, the description of objects having the same structure as the first embodiment will be omitted by being denoted by the same reference numerals. Furthermore, the description of operations and effects that are the same as the first embodiment will be omitted.

Figure 14:
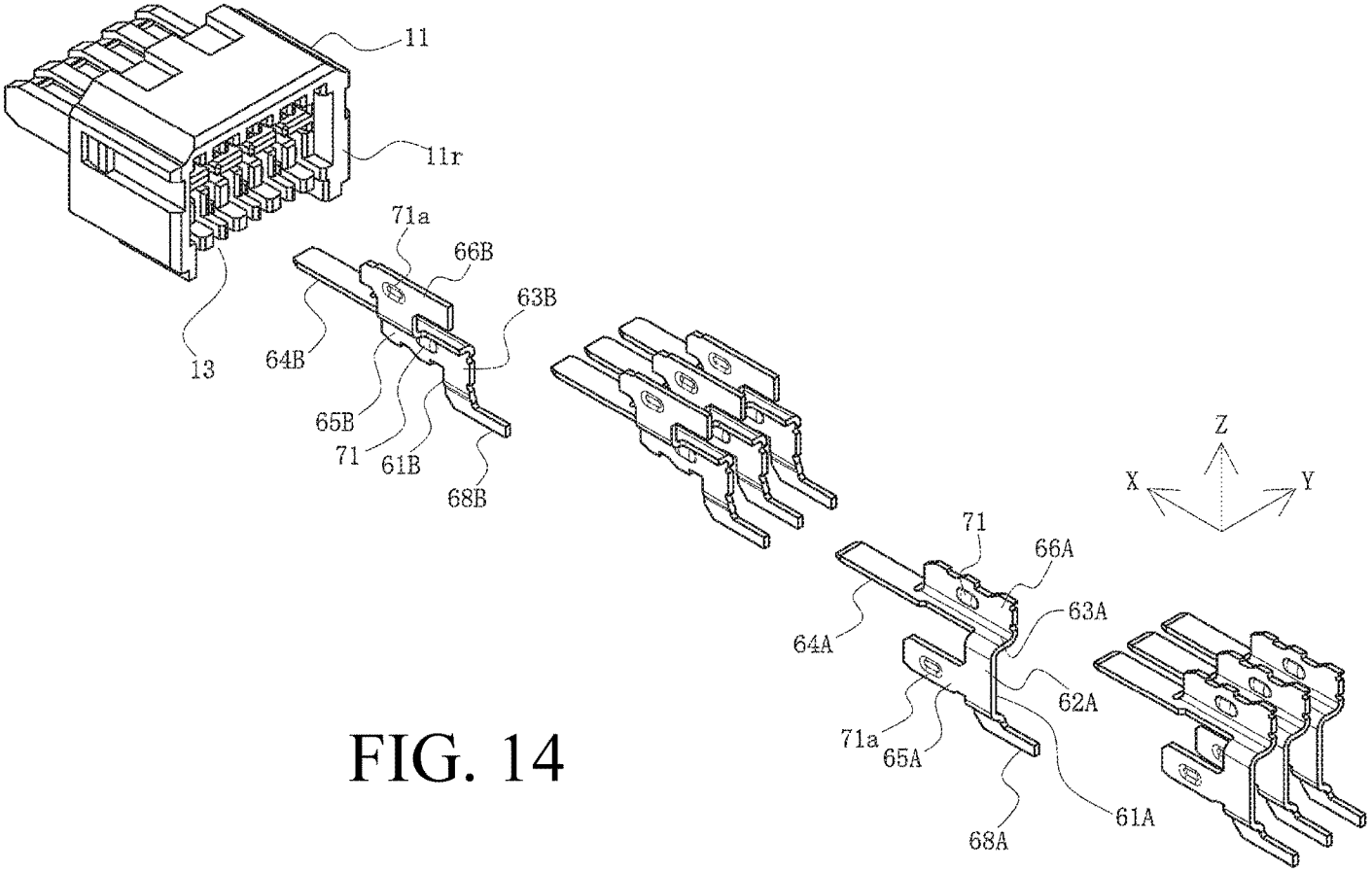
FIG. 14 is an exploded view of the substrate connector in accordance with a second embodiment.
Figure 15:
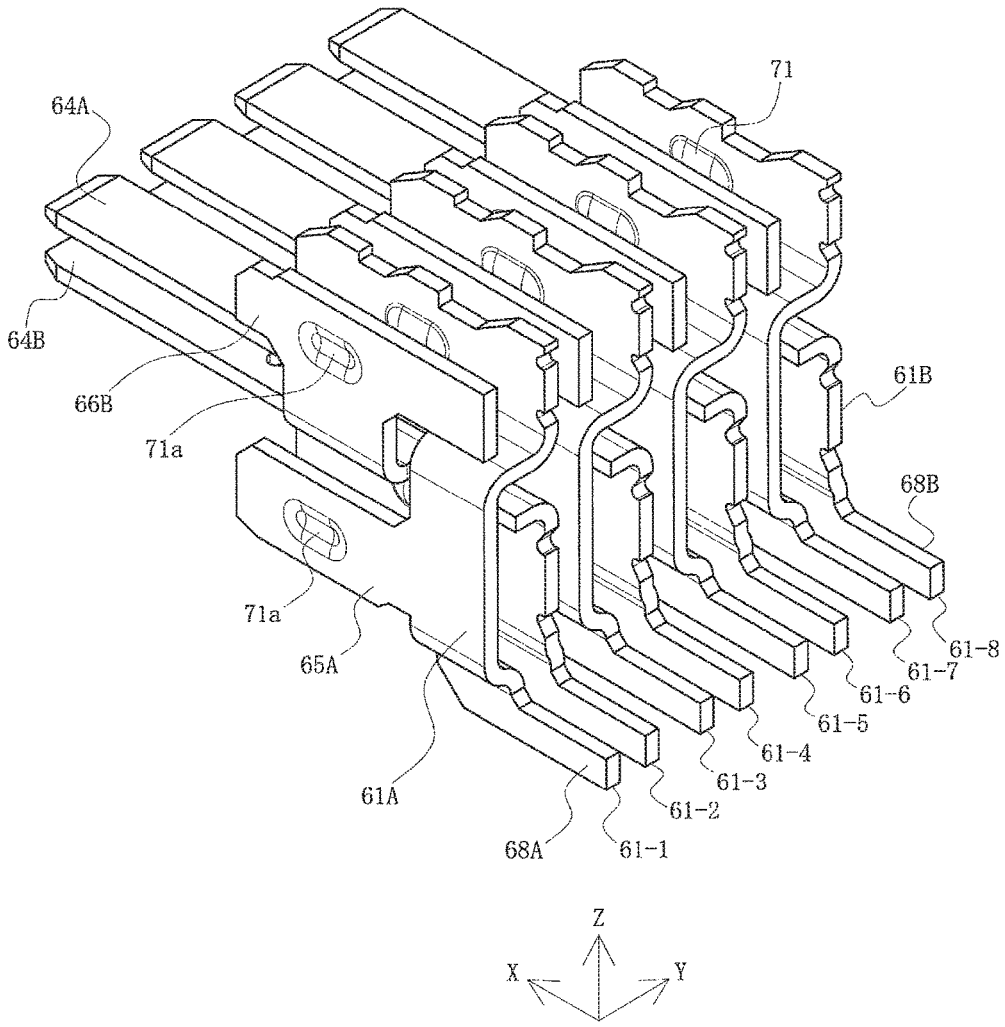
FIG. 15 is a perspective view illustrating an arrangement of the substrate connector terminals in accordance with the second embodiment.
Figure 16A:
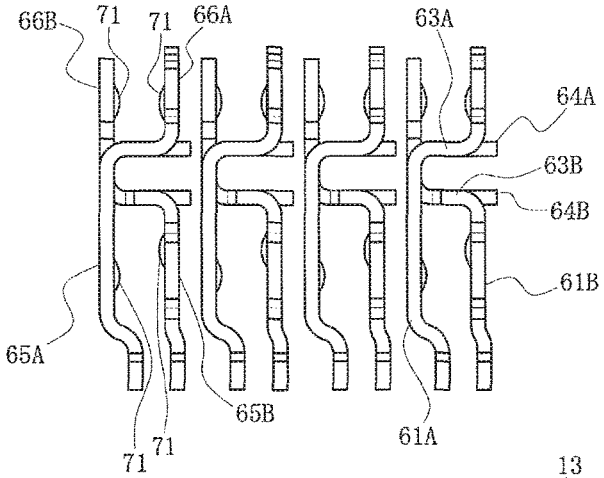
Figure 16B:
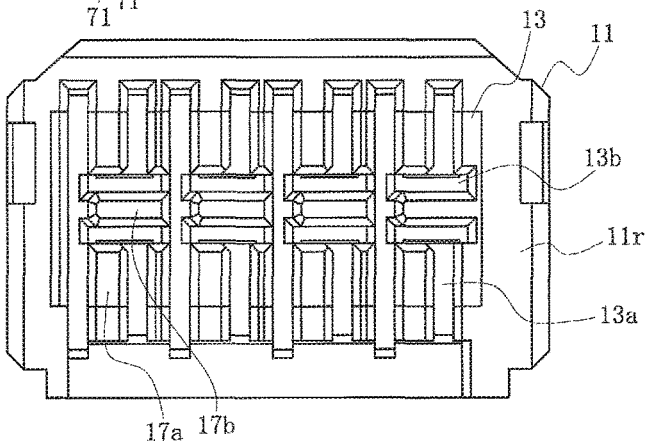
Figure 16C:
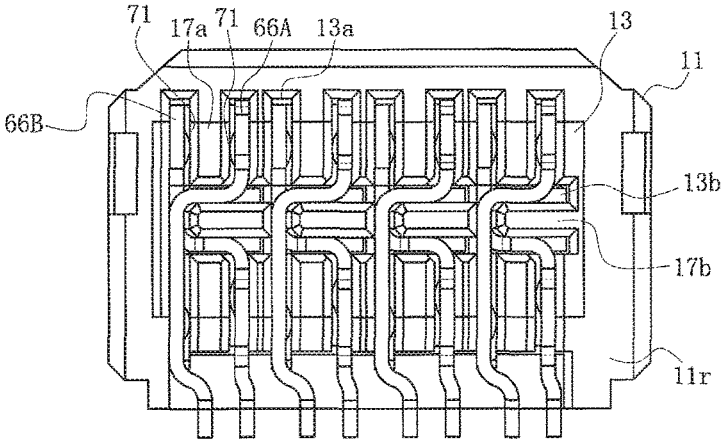

FIG. 14 is an exploded view of the substrate connector in accordance with a second embodiment. FIG. 15 is a perspective view illustrating an arrangement of the substrate connector terminals in accordance with the second embodiment. FIGS. 16A-C are diagrams explaining a state in which the terminals are installed in a substrate connector housing in accordance with the second embodiment. FIG. 16A is a rear view of the terminals, FIG. 16B is a rear view of the housing, and FIG. 16C is a rear view of the housing with the terminals installed in the housing.

In the present embodiment, bulge 71 is formed on the vertical section of terminals 61, for example, by means of a press work. Note that, sunken hollow portion 71*a* exists on the opposite side of the side where bulge 71 is formed as a result of forming bulge 71.

In the example illustrated in the figures, bulge 71 swelling out in the negative Y direction is formed on upper coupling adjuster 66A of first terminal 61A, while bulge 71 swelling out in the positive Y direction is formed on lower coupling adjuster 65A of first terminal 61A. Further, bulge 71 swelling out in the positive Y direction is formed on upper coupling adjuster 66B of second terminal 61B, while bulge 71 swelling out in the negative Y direction is formed on the lower coupling adjuster 65B of second terminal 61B.

Further, as illustrated in FIGS. 16A-C, terminals 61 having bulge 71 formed on the vertical section are housed and installed in terminal housing hollow 13 such that the vertical section thereof is inserted in vertical groove 13*a*, with the horizontal section thereof inserted in lateral groove 13*b*. Here, the dimension (dimension in the Y direction) calculated by adding the plate thickness of the vertical section in terminals 61 and the dimension in which bulge 71 swells out, is configured to be larger than the width (dimension in the Y direction) of vertical groove 13*a*. Consequently, bulge 71 digs into the wall surface of vertical groove 13*a*, and thus, as illustrated in FIG. 16C, the side of the vertical section opposite the side in which bulge 71 is formed is pressed against the inner wall of vertical groove 13*a*, which is opposite the wall into which bulge 71 digs. Thus, the distance between the above described vertical section and the vertical section of adjacent terminal 61 becomes stable, and as a result, the coupling state of the vertical sections adjacent each other in the Y direction is stabilized, in addition to exhibiting a constant coupling strength.

For example, upper coupling adjuster 66A of terminals 61-1 is adjacent to upper coupling adjuster 66B of terminals 61-4 in the Y direction. Since bulge 71 formed on upper coupling adjuster 66A of terminals 61-1 swells out in the negative Y direction, upper coupling adjuster 66A of terminals 61-1 is pressed against the inner wall of vertical groove 13*a* on the positive Y direction side (right side in FIGS. 16A-C). On the other hand, since bulge 71 formed on upper coupling adjuster 66B of terminals 61-4 swells out in the positive Y direction, upper coupling adjuster 66B of terminals 61-4 is pressed against the inner wall of vertical groove 13*a* on the negative Y direction side (left side in FIGS. 16A-C). As a result, the interval between upper coupling adjuster 66A of terminals 61-1 and upper coupling adjuster 66B of terminals 61-4 is maintained constant, thereby stabilizing the coupling state and allowing constant coupling strength to be continuously exhibited. Further, no air layer exists, with only vertical wall 17*a* of housing 11 made of an insulating material generally with a high non-dielectric constant such as a synthetic resin existing between upper coupling adjuster 66A of terminals 61-1 and upper coupling adjuster 66B of terminals 61-4. Thus, constant and high coupling strength can be exhibited.

Note that, in the example illustrated in the figures, although single bulge 71 formed on each of upper coupling adjusters 66 and lower coupling adjusters 65, if necessary, the number of bulges 71, the part on which bulge 71 is formed, the amount of bulge 71 swelling out, the direction of bulge 71 swelling out, etc. can be properly modified.

The configuration of substrate connector 1, wire connector 101 and other elements according to the present embodiment are identical with those according to the first embodiment, thus an explanation thereof is omitted. Further, the operation for mating substrate connector 1 with wire connector 101 according to the present embodiment is identical with the operation according to the first embodiment, thus an explanation thereof is omitted.

As described above, in the present embodiment, housing 11 includes vertical groove 13*a* as the housing groove housing upper coupling adjuster 66A and 66B and lower coupling adjuster 65A and 65B, in first terminal 61A and second terminal 61B, respectively. Further, bulge 71 is formed on at least a part of the surface of upper coupling adjuster 66A and 66B and lower coupling adjuster 65A and 65B which is opposite the inner wall of vertical groove 13*a*. Bulge 71 swells out from the surface on which bulge 71 is formed. Consequently, the coupling of upper coupling adjuster 66A and 66B, along with the coupling of lower coupling adjuster 65A and 65B, are stabilized.

Next, a third embodiment will be described. It should be noted that the description of objects having the same structure as the first and second embodiments will be omitted by being denoted by the same symbols. Furthermore, descriptions of operations and effects that are the same as the first and second embodiments will also be omitted.

Figure 17A:
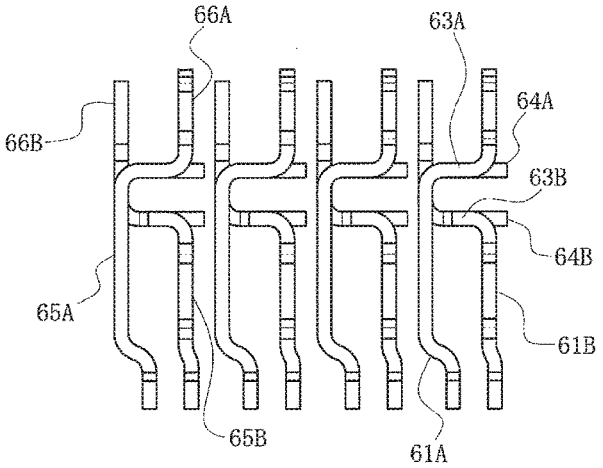
Figure 17B:
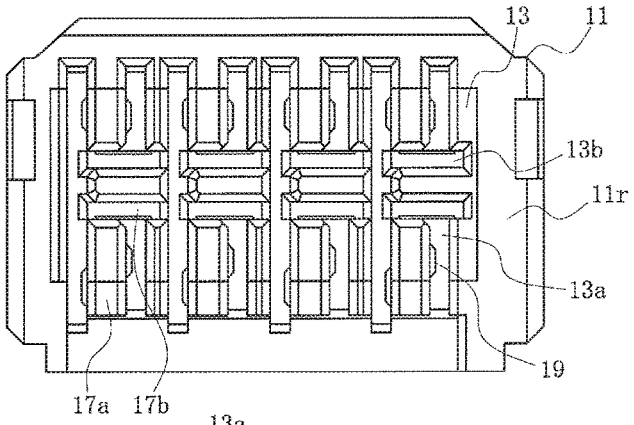
Figure 17C:
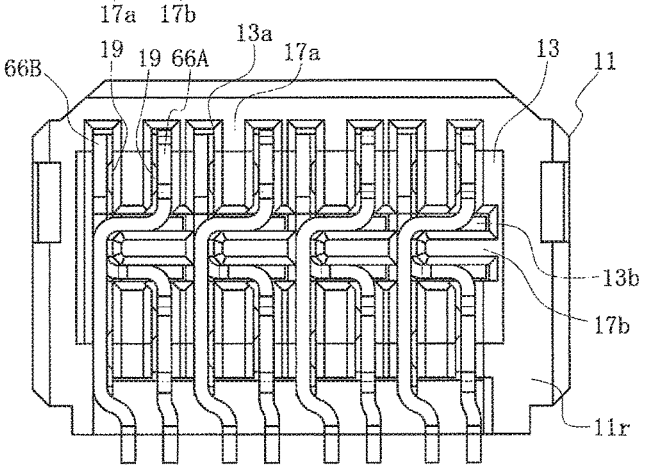

FIGS. 17A-C are diagrams explaining a state in which the terminals are installed in a substrate connector housing in accordance with a third embodiment. FIG. 17A is a rear view of the terminals, FIG. 17B is a rear view of the housing, and FIG. 17C is a rear view of the housing with the terminals installed in the housing.

In the aforementioned second embodiment, bulge 71 is formed on the vertical section of terminals 61. However, in the present embodiment, bulge 71 is not formed on terminals 61, but rather bulge 19 is formed on the wall surface of vertical groove 13*a* in housing 11. Here, the vertical section of terminals 61 is inserted in vertical groove 13*a*.

In the example illustrated in the figures, bulge 19 swelling out in the Y direction is formed on the wall surfaces of vertical groove 13*a* in housing 11 opposite upper coupling adjuster 66 and lower coupling adjuster 65 in terminals 61. Here, the dimension (dimension in the Y direction) of the plate thickness of the vertical section in terminals 61 is configured to be larger than the dimension calculated by reducing the dimension by which bulge 19 swells out from the width (dimension in the Y direction) of vertical groove 13*a*. Consequently, bulge 19 is pressed out by the vertical section inserted in vertical groove 13*a*, thereby causing the surface of the vertical section opposite the surface facing bulge 19, as illustrated in FIG. 17C, to be pressed against the inner wall of vertical groove 13*a* which is opposite the wall from which bulge 19 is pressed out.

For example, upper coupling adjuster 66A of terminals 61-1 is adjacent to upper coupling adjuster 66B of terminals 61-4 in the Y direction. Since bulge 19 formed on the inner wall on the negative Y direction side (left side in FIGS. 17A-C) in vertical groove 13*a* in which upper coupling adjuster 66A of terminals 61-1 is inserted swells out in the positive Y direction, upper coupling adjuster 66A of terminals 61-1 is pressed against the inner wall of vertical groove 13*a* on the positive Y direction side (right side in FIGS. 17A-C). On the other hand, since bulge 19 formed on the inner wall on the positive Y direction side (right side in FIGS. 17A-C) of vertical groove 13*a* in which upper coupling adjuster 66B of terminals 61-4 is inserted swells out in the negative Y direction, upper coupling adjuster 66B of terminals 61-4 is pressed against the inner wall of vertical groove 13*a* on the negative Y direction side (right side in FIGS. 17A-C). As a result, the interval between upper coupling adjuster 66A of terminals 61-1 and upper coupling adjuster 66B of terminals 61-4 is maintained constant, thereby stabilizing the coupling state and allowing a constant coupling strength to be continuously exhibited. Further, no air layer exists, with only vertical wall 17*a* of housing 11 made of an insulating material generally with a high non-dielectric constant such as a synthetic resin existing between upper coupling adjuster 66A of terminals 61-1 and upper coupling adjuster 66B of terminals 61-4. Thus, a constant and high coupling strength can be exhibited.

Note that, in the example illustrated in the figures, although the single bulge 19 is formed on wall surfaces of vertical groove 13*a* in housing 11 opposite each of upper coupling adjusters 66 and lower coupling adjusters 65, if necessary, the number of bulges 19, the part on which bulge 19 is formed, the amount of bulge 19 swelling out, etc. can be properly modified.

The configuration of substrate connector 1, wire connector 101 and other elements according to the present embodiment are identical with those according to the first and second embodiments, thus an explanation thereof is omitted. Further, the operation for mating substrate connector 1 with wire connector 101 according to the present embodiment is identical with the operation according to the first and second embodiments, thus an explanation thereof is omitted.

As described above, in the present embodiment, housing 11 includes vertical groove 13*a* as the housing groove which houses upper coupling adjuster 66A and 66B and lower coupling adjuster 65A and 65B, in first terminal 61A and second terminal 61B, respectively. Further, bulge 19 is formed on at least a part of the surface of the inner wall of vertical groove 13*a* opposite the surface facing upper coupling adjuster 66A and 66B and lower coupling adjuster 65A and 65B. Bulge 19 swells out from the surface on which bulge 19 is formed. Consequently, the coupling of upper coupling adjuster 66A and 66B, along with the coupling of lower coupling adjuster 65A and 65B, are stabilized.

Next, a fourth embodiment will be described. It should be noted that descriptions of objects having the same structure as the first through third embodiments will be omitted by being denoted by the same symbols. Furthermore, likewise, descriptions will be omitted for operations and effects that are the same as the aforementioned first through third embodiments.

Figure 18:
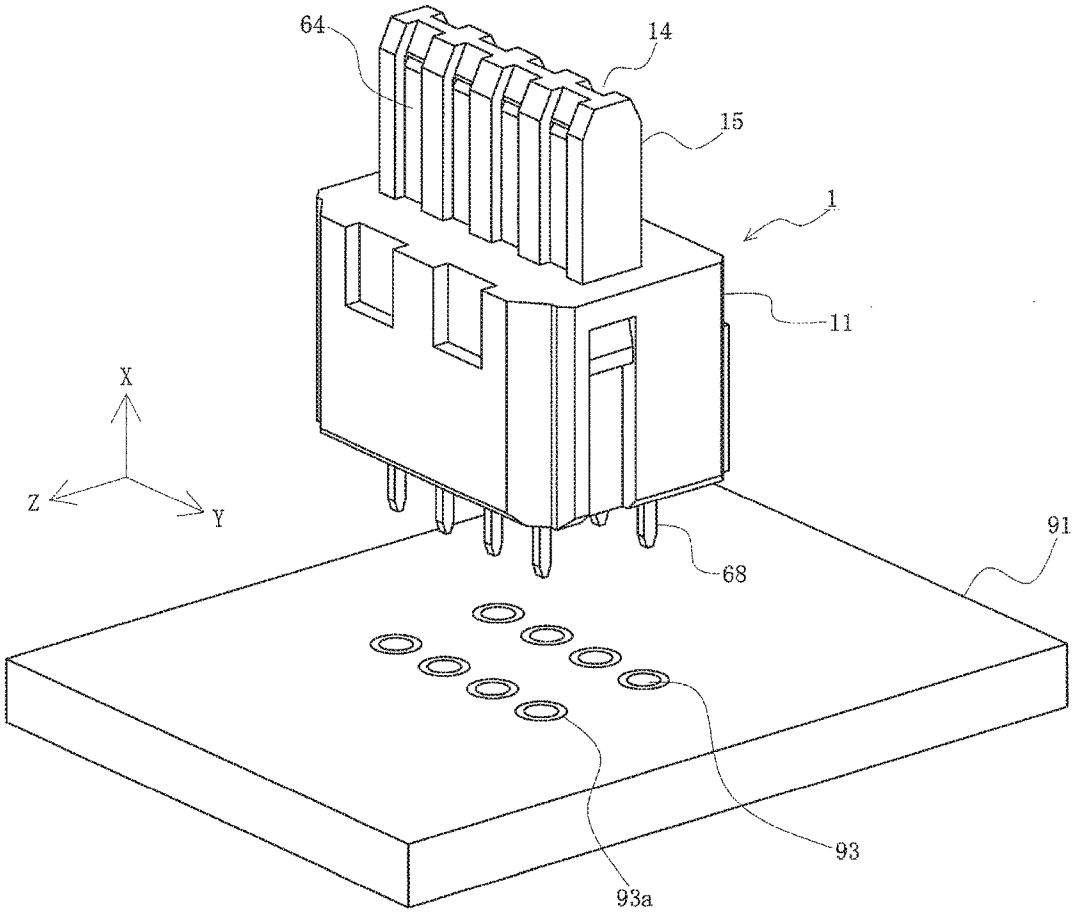
FIG. 18 is a perspective view illustrating the relation between the substrate connector and the substrate in accordance with a fourth embodiment.
Figure 19:
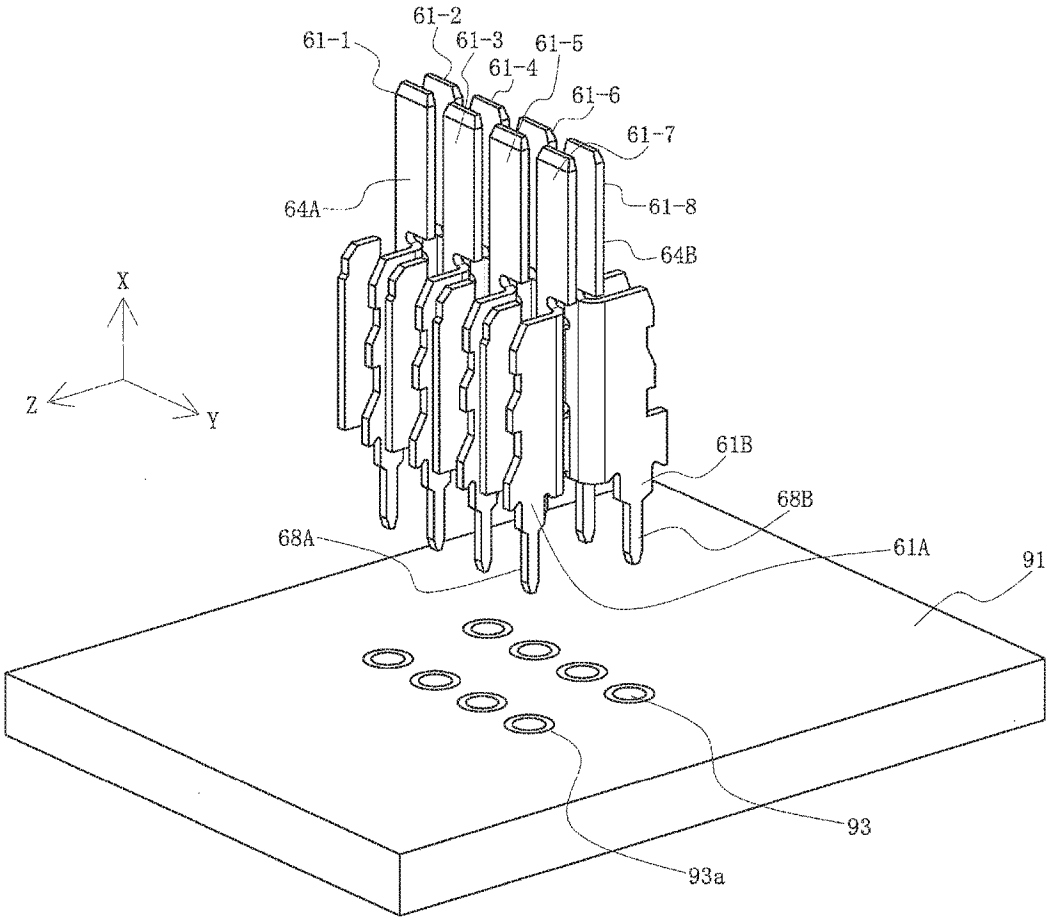
FIG. 19 is a perspective view illustrating the relation between substrate connector terminals and the substrate in accordance with the fourth embodiment.
Figure 20:
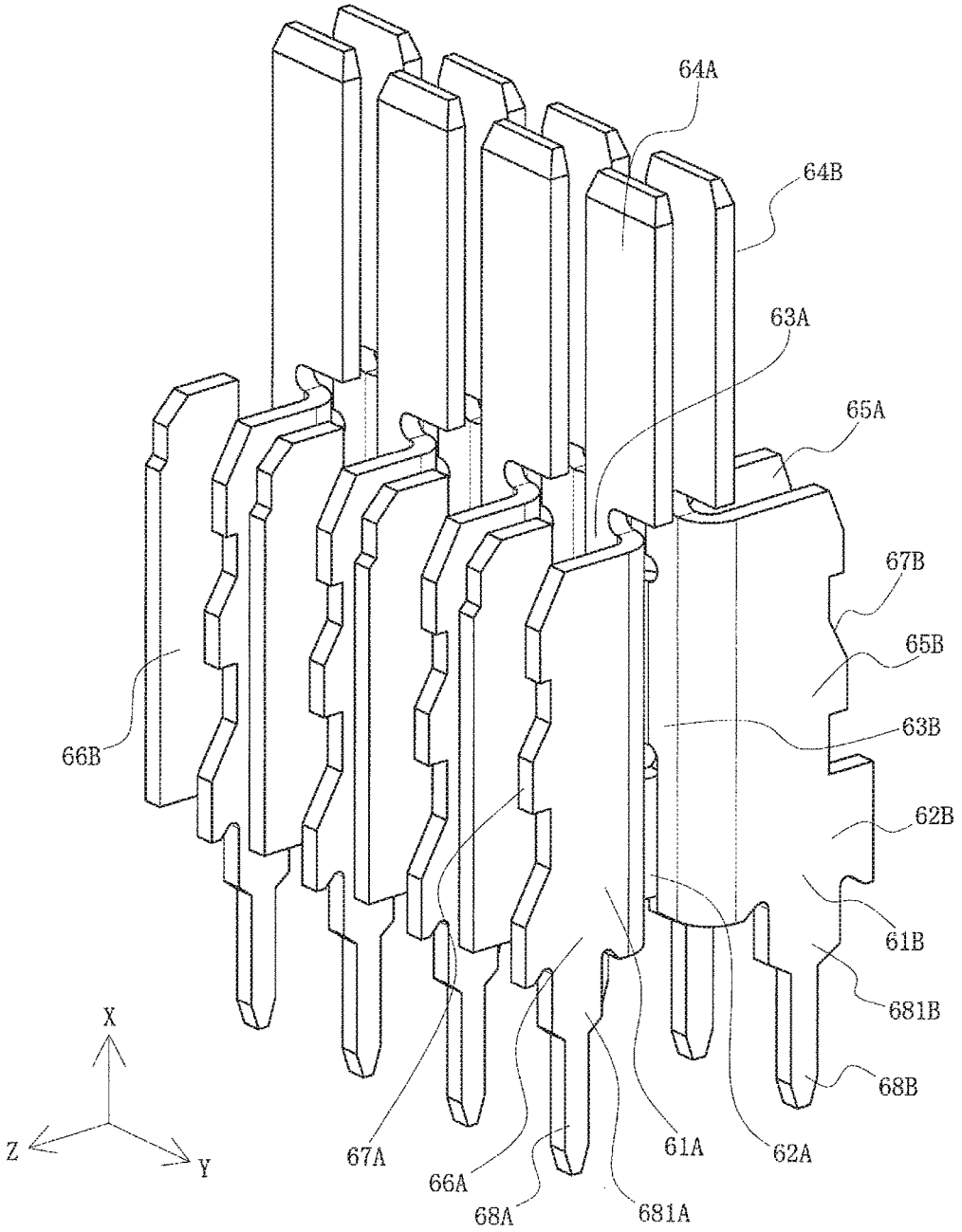
FIG. 20 is a perspective view illustrating an arrangement of the substrate connector terminals in accordance with the fourth embodiment.
Figure 21:
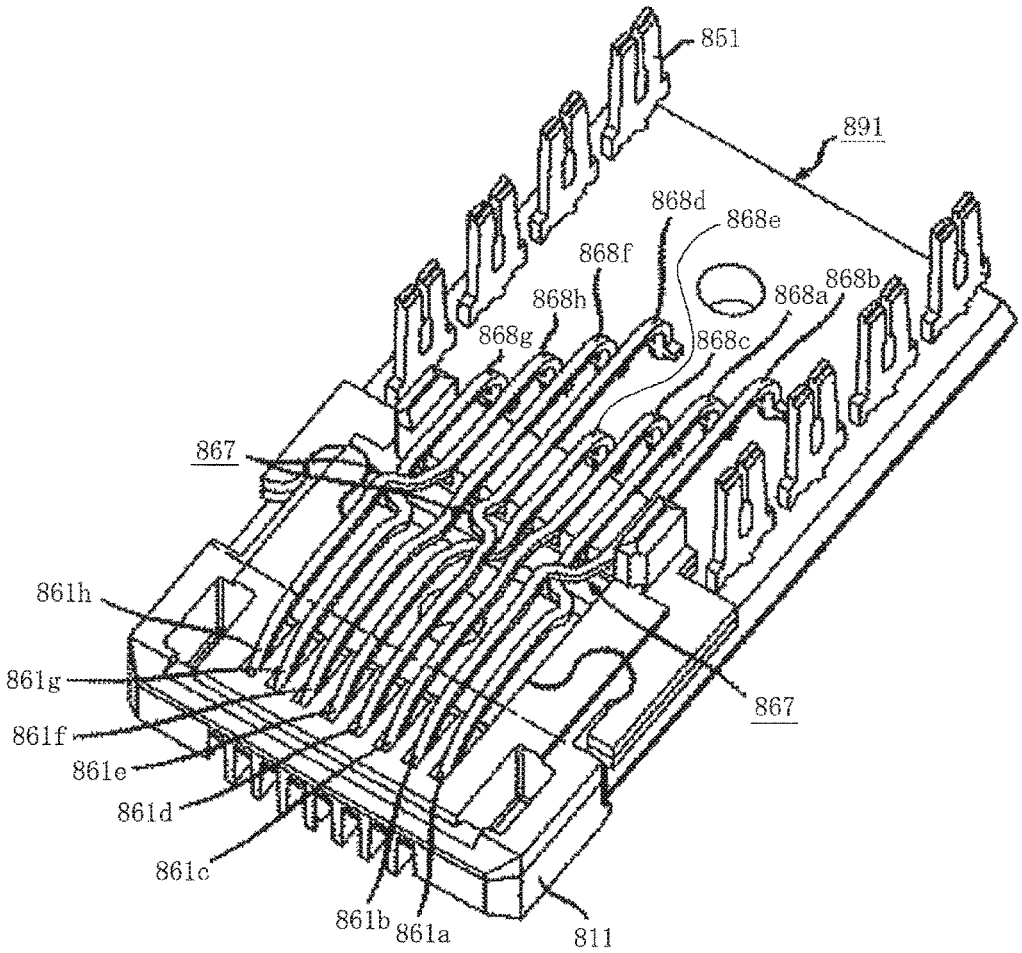
FIG. 21 Prior Art
FIG. 21 is a perspective view illustrating a terminal structure of a known connector.

FIG. 18 is a perspective view illustrating the relation between a substrate connector and a substrate in accordance with a fourth embodiment. FIG. 19 is a perspective view illustrating the relation between substrate connector terminals and the substrate in accordance with the fourth embodiment. FIG. 20 is a perspective view illustrating an arrangement of substrate connector terminals in accordance with the fourth embodiment.

In the first to third embodiments, explanations are provided regarding substrate connector 1 as a so-called right angle type connector that is mounted on substrate 91 in the lateral position to substrate 91, that is, the position in which the X direction as the anteroposterior direction is parallel to the surface of substrate 91. Here, in the present embodiment, an explanation is provided regarding substrate connector 1 as a so-called straight type connector that is mounted on substrate 91 in the upright position, that is, the position in which the X direction as the anteroposterior direction is vertical to the surface of substrate 91.

In the present embodiment, through holes 93, in which tails 68 of terminals 61 are inserted, are formed in substrate 91. Note that, conductive coating 93*a* is formed on the inner wall surfaces and margins of the openings of through holes 93 and conductive coating 93*a* is connected to a conductive trace (not illustrated) formed in substrate 91. In the example illustrated in the figures, through holes 93 are disposed and aligned in the Y direction in two rows. Then, conductive coatings 93*a* facing each other function as a differential signal pair. That is, through holes 93 are disposed and aligned to be configured to form four pairs of differential signal pairs in substrate 91. Note that, similar to the first to third embodiments, regarding terminals 61, each pair of terminals 61-1 and 61-2, terminals 61-3 and 61-4, terminals 61-5 and 61-6, and terminals 61-7 and 61-8 function as a differential signal pair.

Further, each tail 68 has a long narrow pin shape or a bar shape insertable in through hole 93 and is moved in the negative X direction relative to the surface of substrate 91 to be correspondingly inserted through hole 93. Then, tail 68 inserted in through hole 93 is electrically connected to conductive coating 93*a*, preferably by means of soldering, etc.

In the aforementioned first to third embodiments, tail 68A of first terminal 61A is connected to the bottom end, that is, the end in the negative Z direction, of base 62A through tail offset section 621A. On the other hand, in the present embodiment, tail 68A of first terminal 61A is connected to the rear end, that is, the end in the negative X direction of upper coupling adjuster 66A through broad connecting section 681A.

Further, in the aforementioned first to third embodiments, tail 68B of second terminal 61B is connected to the bottom end, that is, the end in the negative Z direction, of base 62B through tail offset section 621B. On the other hand, in the present embodiment, tail 68B of second terminal 61B is connected to the rear end, that is, the end in the negative X direction of base 62B through broad connecting section 681B.

Consequently, in the present embodiment, tails 68A of first terminals 61A are aligned in the Y direction in a row, while tails 68B of second terminals 61B are aligned in the Y direction in a row in the position more on the negative Z direction side comparing with tails 68A of first terminal 61A Note that, tail 68A of first terminal 61A and tail 68B of second terminal 61B can also be offset by the tail offset section the same as in the first embodiment.

The configuration of substrate connector 1, wire connector 101, and other elements according to the present embodiment are identical with those according to the first to third embodiments, thus an explanation thereof is omitted. Further, the operation for mating substrate connector 1 with wire connector 101 according to the present embodiment is identical with the operation according to the first to third embodiments, thus an explanation thereof is omitted.

As described above, in the present embodiment, first terminal 61A further includes tail 68A connected to the rear end of upper coupling adjuster 66A and extending in the X direction, while second terminal 61B further includes tail 68B connected to the rear end of lower coupling adjuster 65B and extending in the X direction. Tail 68A and 68B of first terminal 61A and second terminal 61B are inserted in through holes 93 formed on substrate 91. In other words, substrate connector 1 may be a so-called straight-type connector.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. A connector, comprising a housing and a terminal installed in the housing, wherein the terminal includes a pair consisting of a first terminal and a second terminal, wherein each of the first terminal and the second terminal includes a contact part extending in the anteroposterior direction, an upper plate and a lower plate extending in the vertical direction, and a link section extending in the lateral direction and linking up with the upper plate and the lower plate, and wherein the contact part of the first terminal is opposite the contact part of the second terminal in the vertical direction, the upper plate of the first terminal is opposite the upper plate of the second terminal in the lateral direction, the lower plate of the first terminal is opposite the lower plate of the second terminal in the lateral direction, and the positional relationship between the upper plate of the first terminal and the upper plate of the second terminal in the lateral direction is opposite the positional relationship between the lower plate of the first terminal and the lower plate of the second terminal in the lateral direction.

2. The connector according to claim 1, wherein the positional relationship between the upper plate of the first terminal and the upper plate of the second terminal in the lateral direction and the positional relationship between the lower plate of the first terminal and the lower plate of the second terminal in the lateral direction reverse at the link section.

3. The connector according to claim 1, wherein there are multiple pairs of first terminals and second terminals, with the pairs aligned and arranged in the lateral direction.

4. The connector according to claim 3, wherein the edges of the contact parts in one pair and the edges of the contact parts in an adjacent pair face each other in the lateral direction.

5. The connector according to claim 3, wherein the surfaces of the upper plate and the lower plate in one pair and the surfaces of the upper plate and the lower plate in an adjacent pair face each other in the lateral direction.

6. The connector according to claim 1, wherein a pair consisting of the first terminal and the second terminal transmits a differential signal.

7. The connector according to claim 1, wherein the housing includes a housing groove housing the upper plate and the lower plate of the first terminal and the second terminal, and a bulge swelling out from at least part of the surface of the upper plate and the lower plate opposite the inner wall of the housing groove is formed.

8. The connector according to claim 1, wherein the housing includes a housing groove housing the upper plate and the lower plate of the first terminal and the second terminal, and a bulge swelling out from at least part of the surface of the inner wall of the housing groove opposite the upper plate and the lower plate is formed.

9. The connector according to claim 1, wherein each of the first terminal and the second terminal further include a base connected to a rear section of the lower plate and extending in the vertical direction, along with a tail connected to the bottom end of the base and extending in the anteroposterior direction, wherein the bottom end of the tail is connected to a plate shaped connection pad disposed on the surface of a substrate.

10. The connector according to claim 1, wherein the first terminal further includes a tail connected to the rear end of the upper plate and extending in the anteroposterior direction, while the second terminal further includes a tail connected to the rear end of the lower plate and extending in the anteroposterior direction, and the tails of the first terminal and the second terminal are inserted in the through holes formed on the substrate.

* * * * *